US012565248B2

(12) United States Patent
Richardson et al.

(10) Patent No.: US 12,565,248 B2
(45) Date of Patent: Mar. 3, 2026

(54) MULTIPLE LINE COMPRESSION SPRING DAMPENING SYSTEM

(71) Applicants: Michael Troy Richardson, Washington, UT (US); Michael Timothy Holder, Whitesburg, GA (US)

(72) Inventors: Michael Troy Richardson, Washington, UT (US); Michael Timothy Holder, Whitesburg, GA (US)

( * ) Notice: Subject to any disclaimer, the term of this patent is extended or adjusted under 35 U.S.C. 154(b) by 596 days.

(21) Appl. No.: 18/100,512

(22) Filed: Jan. 23, 2023

(65) Prior Publication Data

US 2023/0234625 A1 Jul. 27, 2023

Related U.S. Application Data

(60) Provisional application No. 63/301,604, filed on Jan. 21, 2022.

(51) Int. Cl.

| | |
|---|---|
| ***B61H 9/02*** | (2006.01) |
| ***B61B 7/06*** | (2006.01) |
| ***B61H 7/00*** | (2006.01) |

(52) U.S. Cl.

CPC ..... *B61H 9/02* (2013.01); *B61B 7/06* (2013.01); *B61H 7/00* (2013.01)

(58) Field of Classification Search

CPC ..... B61B 12/105; B61B 7/00; B61B 7/06; F16D 63/008; B61H 7/00; B61H 9/02

See application file for complete search history.

(56) References Cited

U.S. PATENT DOCUMENTS 3,353,503 A * 11/1967 Pettit ..... B61B 7/06 104/298
8,424,460 B2 * 4/2013 Lerner ..... B61B 7/00 104/113
8,490,751 B2 7/2013 Allington et al.
(Continued)

FOREIGN PATENT DOCUMENTS

CN 113353105 A * 9/2021 ..... B61B 7/06
CN 116890883 A * 10/2023 ..... B61B 3/02
(Continued)

OTHER PUBLICATIONS

KR_101710700_B1 FIT machine translation (Year: 2025).*
KR_102002145_B1 FIT machine translaion (Year: 2025).*

*Primary Examiner* — Paul N Dickson
*Assistant Examiner* — Maxwell L Meshaka
(74) *Attorney, Agent, or Firm* — Kunzler Needham & Hilton; Scott D. Thorpe

(57) ABSTRACT

For stopping a zip line trolley, a zip line braking system includes an impact device, a non-zip liner parallel cable, a freewheeling pulley, a tether, and at least one spring. The impact device rides on a zip line cable, wherein the impact device is positioned down the zip line cable from a zip line trolley that rides on the zip line cable. The impact device does not ride on the non-zip liner parallel cable. The tether connects the impact device to a first freewheeling pulley. The impact device applies a force to the first freewheeling pulley via the tether in response to a zip line trolley contacting the freewheeling pulley. The at least one spring is disposed on the non-zip liner parallel cable and slows the freewheeling pulley, wherein the freewheeling pulley decelerates the impact device and the zip line trolley via the tether to a stop.

14 Claims, 30 Drawing Sheets

(56) References Cited

U.S. PATENT DOCUMENTS 8,807,292 B2 * 8/2014 Liston ..... B60T 7/16 188/65.1
8,851,235 B2 10/2014 Allington et al.
9,016,435 B2 4/2015 Allington et al.
9,021,962 B2 * 5/2015 Hackett ..... B61H 9/02 104/113
9,033,115 B2 * 5/2015 Lerner ..... B60T 1/10 188/62
9,174,621 B2 * 11/2015 Manes ..... B60T 13/74
9,272,166 B2 * 3/2016 Hartman ..... A62B 1/08
9,573,605 B2 * 2/2017 Steele ..... A63G 21/22
9,789,410 B2 * 10/2017 Dose ..... B61H 9/02
10,086,853 B2 * 10/2018 Hartman ..... A62B 1/08
10,461,513 B2 * 10/2019 Wall ..... B61B 7/06
10,471,971 B2 * 11/2019 Richardson ..... B61B 7/00
10,807,613 B2 * 10/2020 Richardson ..... B61B 12/028
10,835,834 B2 * 11/2020 Wilson ..... H02K 49/10
11,130,507 B2 * 9/2021 Domeck ..... B61H 9/06
11,661,091 B2 * 5/2023 Deel ..... B61B 12/02 191/40
11,772,684 B2 * 10/2023 Richardson ..... B61B 12/028 104/113
12,071,168 B2 * 8/2024 Bunch ..... B61B 7/00
2009/0255436 A1 * 10/2009 Buckman ..... B60T 11/046 104/117.1
2012/0145498 A1 * 6/2012 Liston ..... B61H 9/02 188/378
2012/0160122 A1 * 6/2012 Lerner ..... B61B 7/00 104/113
2012/0318609 A1 * 12/2012 Hartman ..... A62B 1/08 188/65.1
2013/0118842 A1 * 5/2013 Lerner ..... B61H 9/02 188/62
2013/0287533 A1 * 10/2013 Manes ..... F16D 63/008 414/749.6
2014/0150685 A1 * 6/2014 Checketts ..... F16F 9/0209 188/301
2014/0158012 A1 * 6/2014 Hackett ..... B61H 9/02 188/65.1
2015/0303663 A1 * 10/2015 Wall ..... B61B 7/06 105/49
2016/0046305 A1 * 2/2016 Cylvick ..... B61L 21/10 701/19
2016/0159376 A1 * 6/2016 Hartman ..... A62B 1/08 254/375
2016/0193535 A1 * 7/2016 Dose ..... B61B 7/00 104/113
2017/0088150 A1 * 3/2017 Christinet ..... F16D 63/008
2018/0009449 A1 * 1/2018 Mosher ..... B61B 7/04
2018/0126287 A1 * 5/2018 Wilson ..... A63G 21/20
2018/0214782 A1 * 8/2018 Hackett ..... A63G 21/22
2018/0287352 A1 * 10/2018 Wall ..... B61B 12/10
2018/0304907 A1 * 10/2018 Richardson ..... A63G 21/22
2018/0326957 A1 11/2018 McGowan
2019/0232985 A1 * 8/2019 Domeck ..... F16D 63/008
2020/0023865 A1 * 1/2020 Richardson ..... B61B 7/00
2020/0079401 A1 * 3/2020 Bunch ..... B61B 12/10
2020/0198662 A1 * 6/2020 Deel ..... B61B 7/00
2020/0339166 A1 * 10/2020 Budge ..... B61H 9/02
2021/0061316 A1 * 3/2021 Richardson ..... B61B 7/00
2021/0170285 A1 * 6/2021 Wilson ..... F16D 63/008
2022/0153323 A1 * 5/2022 Budge ..... B61K 7/18
2023/0234625 A1 * 7/2023 Richardson ..... B61B 7/06 104/115
2023/0243412 A1 * 8/2023 Budge ..... F16H 55/50 474/10
2023/0382436 A1 * 11/2023 Deel ..... B61B 7/00
2023/0382437 A1 * 11/2023 Richardson ..... B61B 12/028
2023/0415795 A1 * 12/2023 Richardson ..... B61B 7/00
2024/0270289 A1 * 8/2024 Caputo ..... B61B 12/002
2025/0100590 A1 * 3/2025 Bunch ..... B61B 7/04

FOREIGN PATENT DOCUMENTS

JP 7650554 B1 * 3/2025
KR 20160118697 A * 10/2016 ..... A63G 21/00
KR 101710700 B1 * 2/2017 ..... A63G 21/22
KR 101947510 B1 * 2/2019 ..... A63G 21/22
KR 102002145 B1 * 10/2019 ..... B61B 12/00
KR 102171339 B1 * 11/2020 ..... A63G 21/22
KR 102188253 B1 * 12/2020 ..... A63G 25/00
KR 102188254 B1 * 12/2020 ..... B62J 1/02
KR 20210049249 A * 5/2021 ..... B61B 12/04
KR 20220167554 A * 12/2022 ..... H02G 7/12
KR 102594088 B1 * 10/2023 ..... A63G 21/22
WO WO-2023153942 A1 * 8/2023 ..... B61K 9/00

* cited by examiner

MULTIPLE LINE COMPRESSION SPRING DAMPENING SYSTEM

CROSS REFERENCE TO RELATED APPLICATIONS

This application is a conversion of and claims priority to U.S. Provisional Patent Application 63/301,604 entitled "MULTIPLE LINE COMPRESSION SPRING DAMPENING SYSTEM" and filed on Jan. 21, 2021 for Michael Troy Richardson, which is incorporated herein by reference.

FIELD

The subject matter disclosed herein relates to a zip line trolley.

BACKGROUND

Zip line trolleys must be brought to a safe stop.

BRIEF DESCRIPTION OF THE DRAWINGS

A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

For spring system reducing speed on a cable, the zip line trolley includes a multi concave wheeled trolley, a two-wheeled free-wheeling trolley, or a passive braking trolley with a concave wheel and a concave brake. The spring system is disposed on a proximal end of multiple column frame or suspended above by a truss supporting a cable or a cable which may be spread between columns. The parallel cable secondary braking system is suspended above the zip line cable and primary spring system can be spread between columns or suspended above the zip line cable. The cable connectors are supported by a truss or between a perpendicular cable forming T-section with an array of springs parallel above the zip line cable. The apparatus includes several parallel arrays of compression springs positioned horizontally above the zip line cable to dampen and slow trolley with variable weighted hanging masses suspended below traversing the zip line cable. The distal ends of the spring arrays are connected perpendicularly by a pulleys or sliding apparatuses that move about the cables horizontally when compressed or decompressed. The weighted masses or zip line rider is tethered below a single and passive brake or dual concave freewheeling zip line pulley freely travers the zip line in a controlled or an uncontrolled descent of a two-wheeled free-wheeling trolley or a passive braking trolley impacts with a force then slowed to a stop by the zip line braking system. A more particular description of the embodiments briefly described above will be rendered by reference to specific embodiments that are illustrated in the appended drawings.

The description of elements in each figure may refer to elements of proceeding figures. Like numbers refer to like elements in all figures, including alternate embodiments of like elements.

Figure 1:
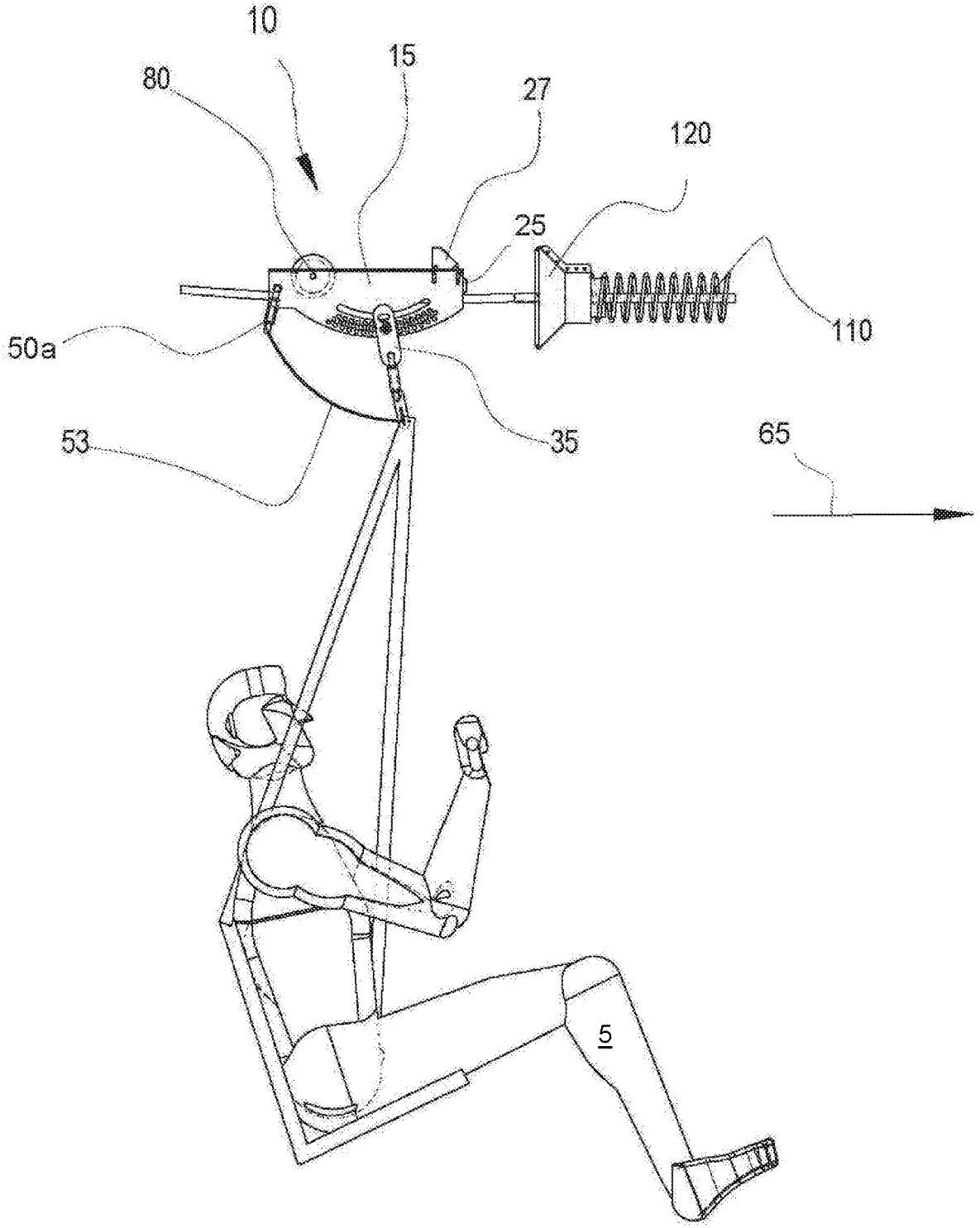
FIG. 1 is a side view drawing of one embodiment of a rider suspended below the zip line trolley.

FIG. 1 is a side view drawing of one embodiment of a rider 5 suspended below the zip line trolley 10. The rider is suspended from a proximal carabinier 50*b*. The zip line trolley 10 includes a frame 15, a wheel 20, a wheel bearing 80, a brake 25, a brake stop angled tab hitch 27, and a rotatable lever 35. A receiver 120 and spring 110 are also shown. The wheel 20 and the brake 25 may travel along a top of the cable 45. The zip line trolley 10 may travel along a cable 45 in a direction of travel 65.

The zip line trolley 10 may experience a significant acceleration while descending a cable. As a result, it may be important to apply a braking force. Unfortunately, in the past, brakes have been large in order to provide a sufficient braking force. In addition, the zip line trolleys have been large, making it difficult to remove the trolleys from the cable 45. As a result, the zip line trolley 10 may be constructed in a small size that is easily removed from the cable 45. The zip line trolley 10 may make contact with the receiver 120 and may compress the spring 110 or series of springs 110.

Figure 2:
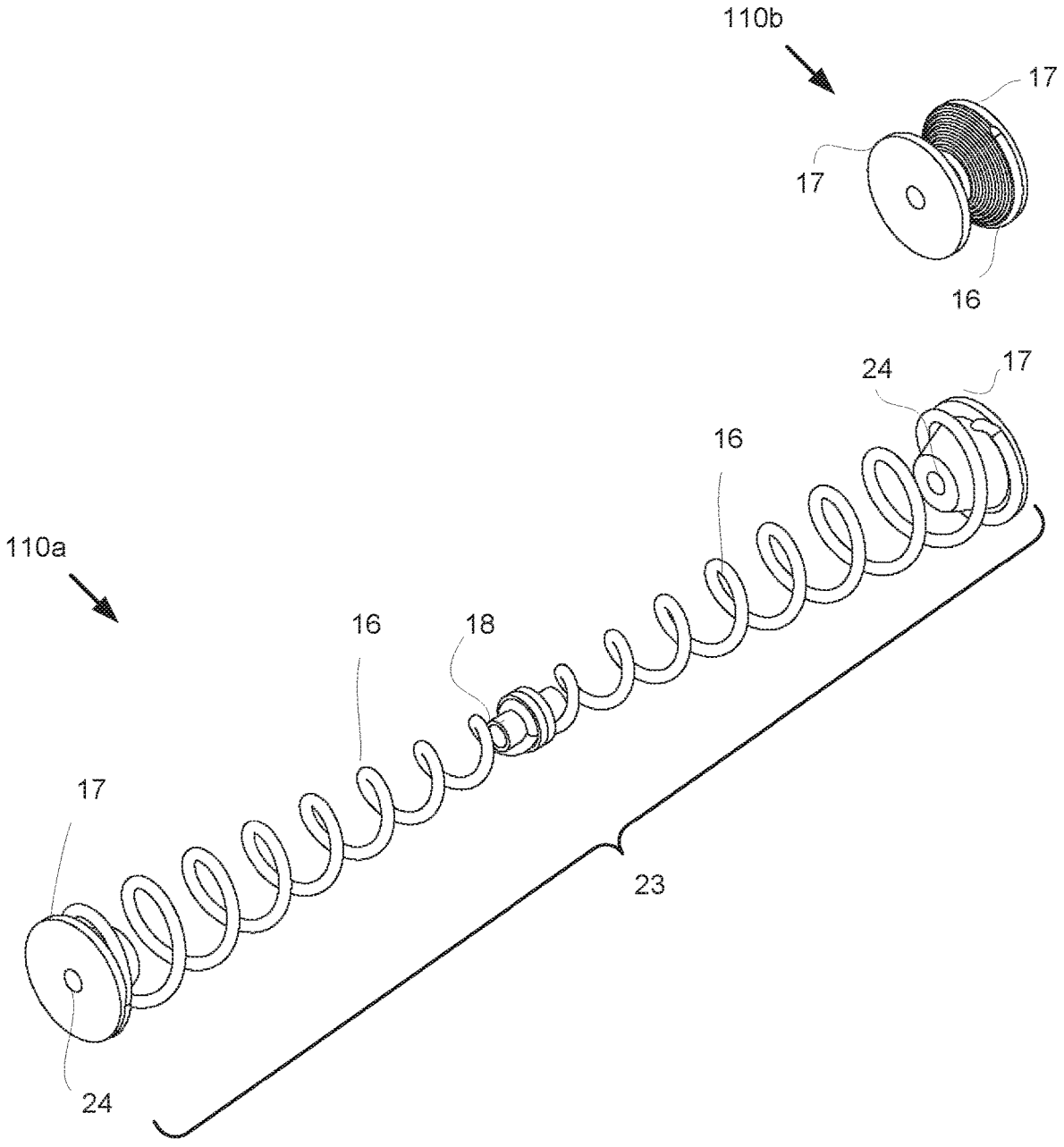
FIG. 2 is a perspective drawing illustrating one embodiment of a spring.

FIG. 2 is a perspective drawing illustrating one embodiment of a spring 110. In the depicted embodiment, an uncompressed spring 110*a* and a compressed spring 110*b* are shown for one spring segment 23. A spring segment 23 may include spring coils 16, one or more end caps 17, and a spring spacer 18. In one embodiment, the spring coils 16 may be formed as a single helical hourglass. Alternatively, the spring coils 16 may be formed as two helical cones. The spring coils 16 may have a slope such that when the spring segment 23 is compressed, each spring coils 16 nests within a neighboring spring coils 16 as shown in FIG. 141. As a result, the spring segment 23 may be compressed from a long length to a short length.

In one embodiment, the spring spacer 18 connects two helical cone spring coils 16. In addition, the spring spacer 18 may glide on the cable 45 through the center of the spring segment 23. The end caps 17 may terminate the spring coils 16. In one embodiment, the cable 45 passes through a hole 24 in each end cap 17. The hole 24 may receive a portion of the brake stop angled tab hitch 27 to increase the braking force.

The spring segment 23 comprises a plurality of spring coils 16. The brake stop angled tab hitch 27 contacts the spring segment 23 and compresses the spring segment 23. In one embodiment, an end cap 17 of the spring segment 23 contacts the brake stop angled tab hitch 27. The brake stop angled tab hitch 27 may compress the spring coils 16 of the spring segment 23. The spring coils 16 of the compressed spring segment 23 may nest completely within a neighboring spring coil 16.

Figure 3:
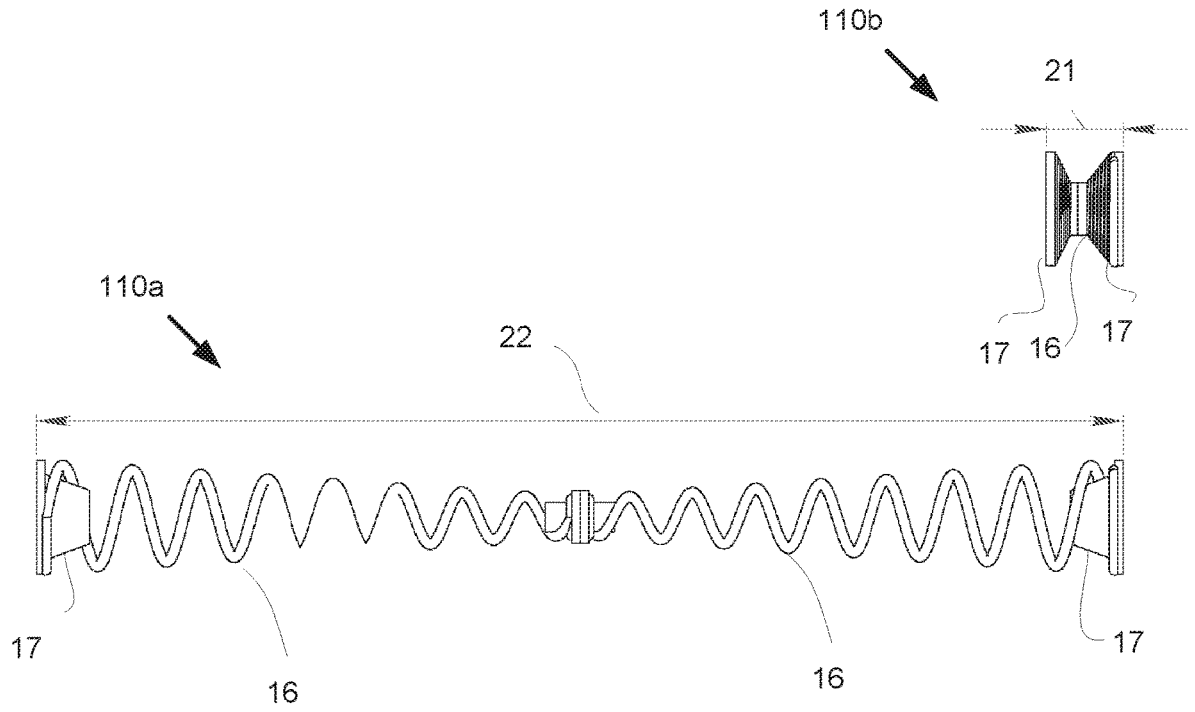
FIG. 3 is a side view drawing illustrating one embodiment of a spring.

FIG. 3 is a side view drawing illustrating one embodiment of the spring 110 of FIG. 2. In the depicted embodiment, one spring segment 23 has an uncompressed length 22. The uncompressed length 22 may be in the range of 2 to 6 inches. In addition, the spring segment 23 has a compressed length 21. The compressed length 21 may be in the range of 0.5 to 2.25 inches.

Figure 4:
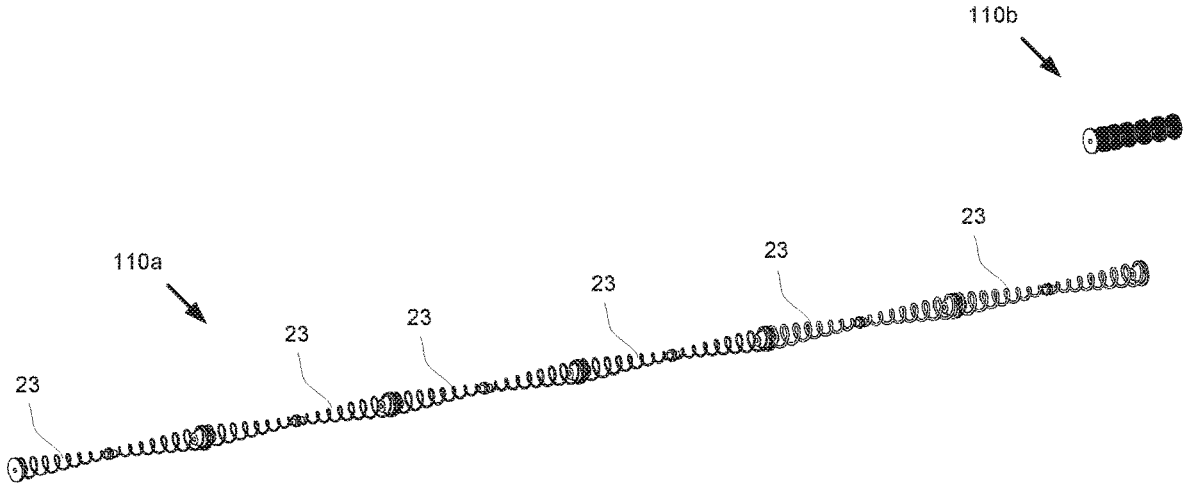
FIG. 4 is a perspective drawing illustrating one embodiment of a spring.

FIG. 4 is a perspective drawing illustrating one embodiment of a spring 110. In the depicted embodiment, the spring 110 is shown as a compressed spring 110*b* and an uncompressed spring 110*a*. The spring 110 includes a plurality of spring segments 23.

Figure 5:
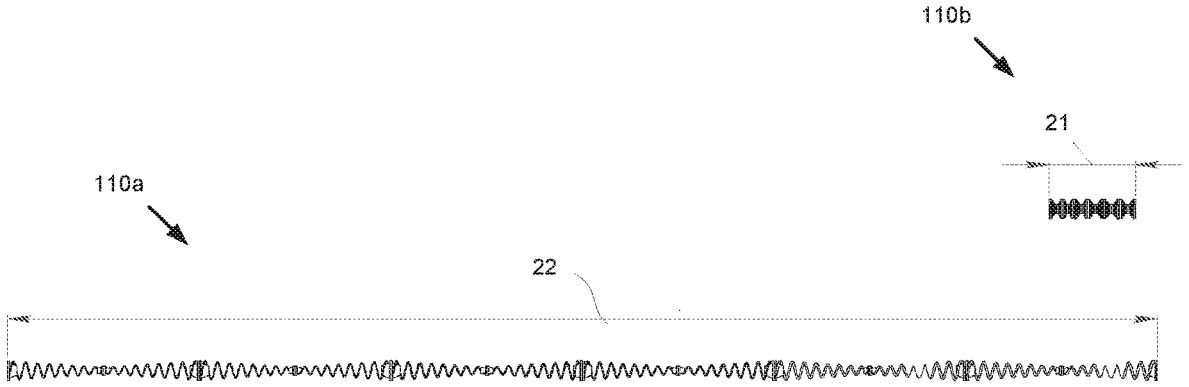
FIG. 5 is a side view drawing illustrating one embodiment of a spring.

FIG. 5 is a side view drawing illustrating one embodiment of the spring 110 of FIG. 4. The uncompressed spring 110*a* may have an uncompressed length 22 in the range of 16 to 20 feet. In addition, the compressed spring 110*b* may have a compressed length 21 in the range of 1 to 2 feet.

Figure 6:
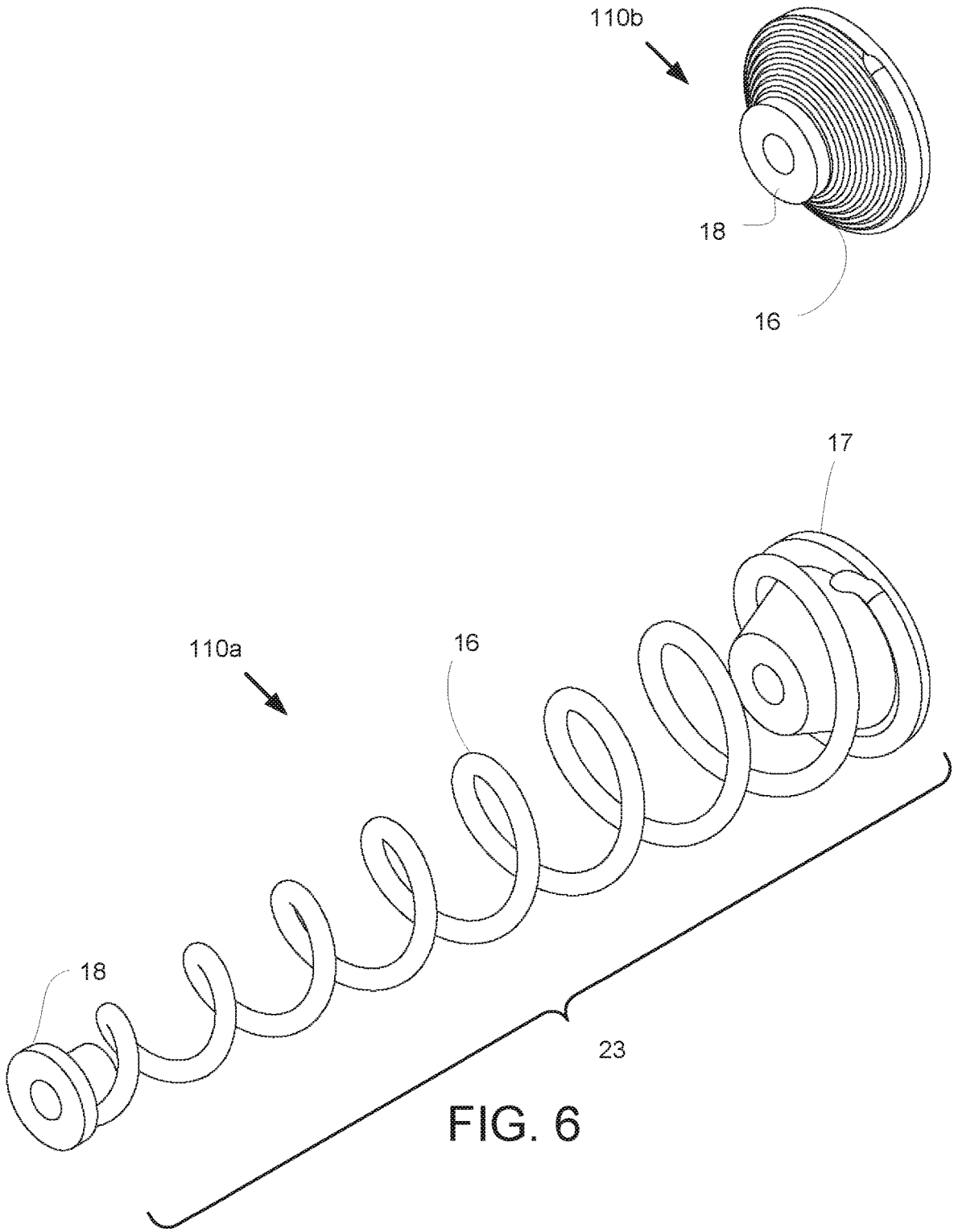
FIG. 6 is a perspective drawing illustrating one embodiment of a spring.

FIG. 6 is a perspective drawing illustrating one embodiment of a spring 110. In the depicted embodiment, a spring segment 23 includes a single helical cone of spring coils 16. The spring 110 is shown as an uncompressed spring 110*a* and a compressed spring 110*b*.

Figure 7:
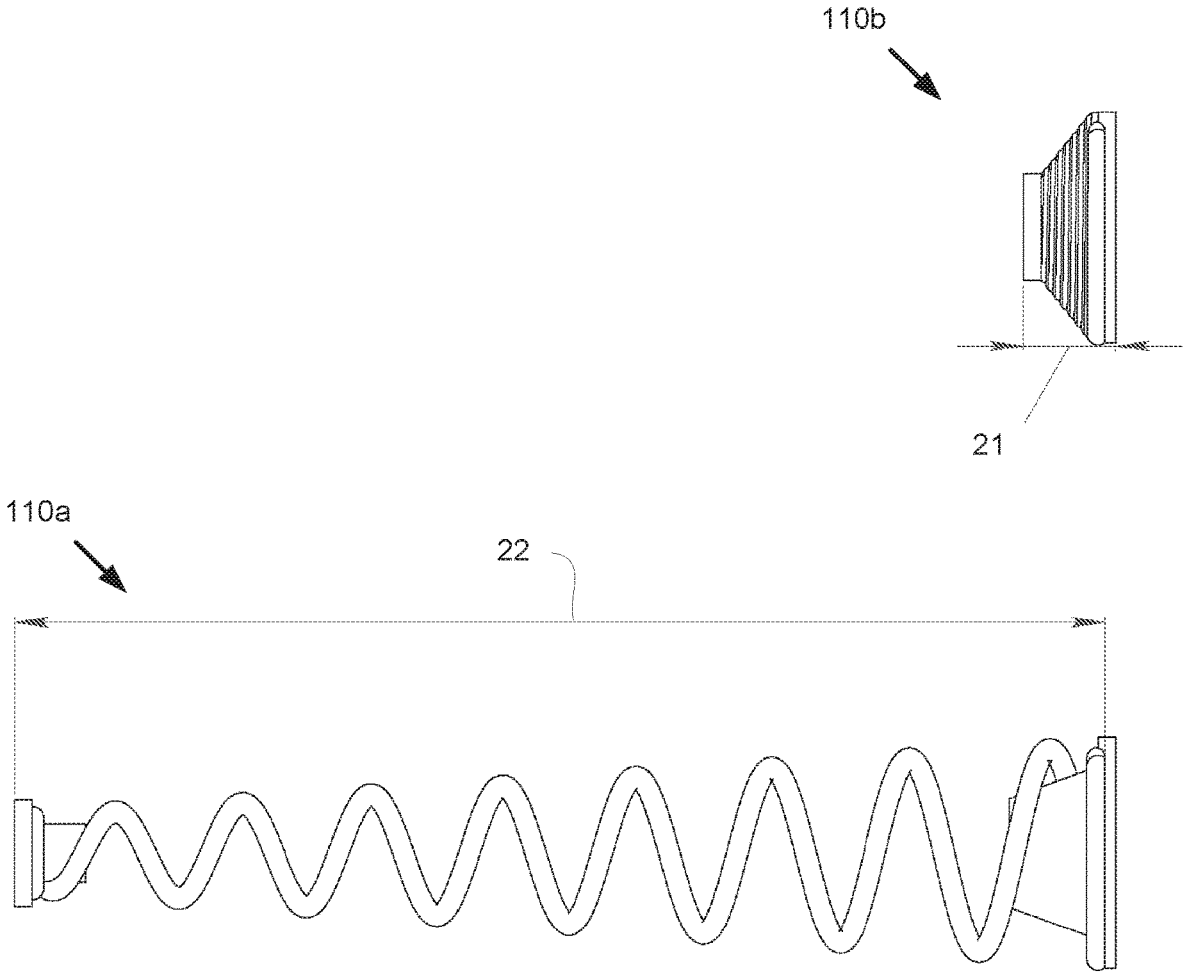
FIG. 7 is a side view drawing illustrating one embodiment of a spring.

FIG. 7 is a side view drawing illustrating one embodiment of the spring 110 of FIG. 6. The uncompressed spring 110*a* has an uncompressed length 22. The uncompressed length 22 may be in the range of 1 to 4 inches. The compressed spring 110*b* has a compressed length 21. The compressed length 21 may be in the range of 0.5 to 1.5 inches.

Figure 8:
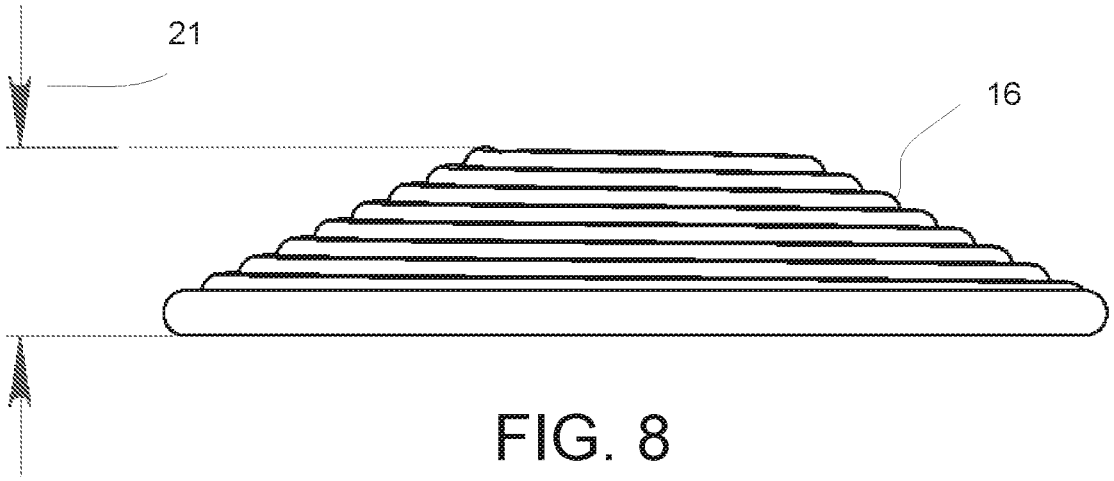
FIG. 8 is a side view drawing illustrating one embodiment of a spring.

FIG. 8 is a side view drawing illustrating one embodiment of the spring coils 16 of a compressed spring 110*b* with the compressed length 21.

Figure 9:
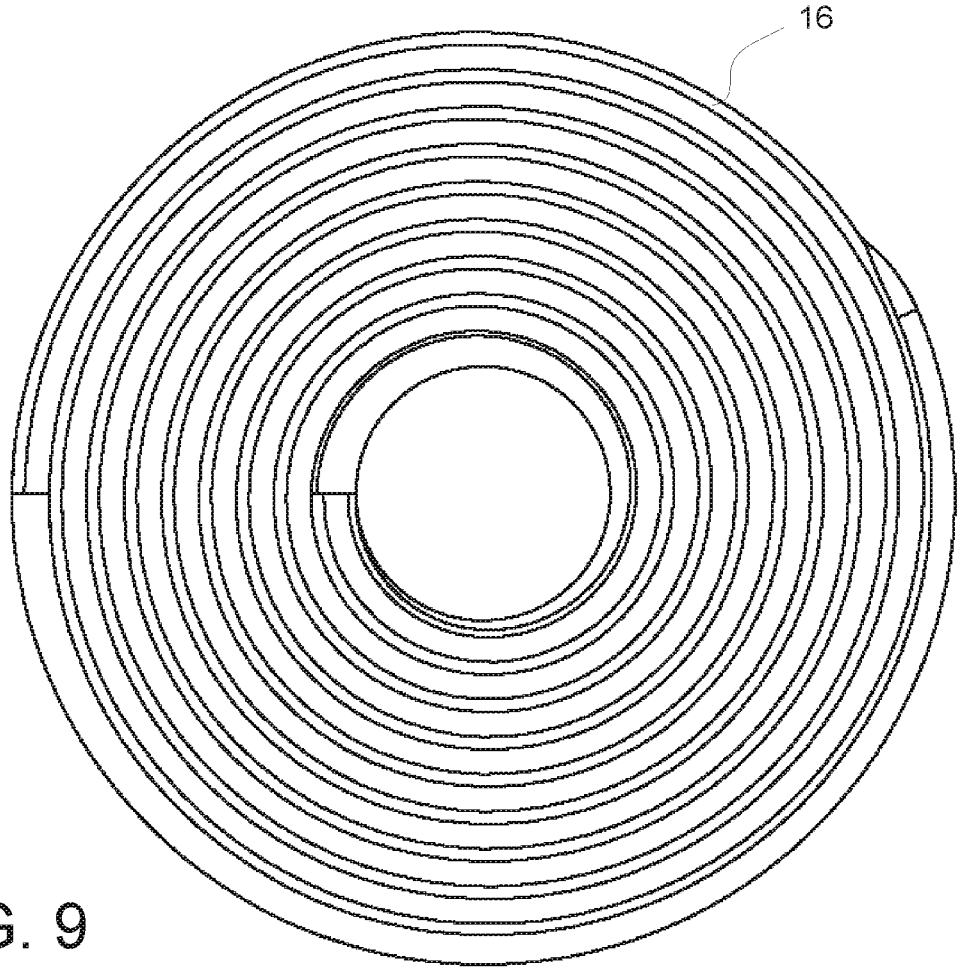
FIG. 9 is a top view drawing illustrating one embodiment of a spring.

FIG. 9 is a top view drawing illustrating one embodiment of the spring coils 16 of the compressed spring 110*b* of FIG. 8.

Figure 10:
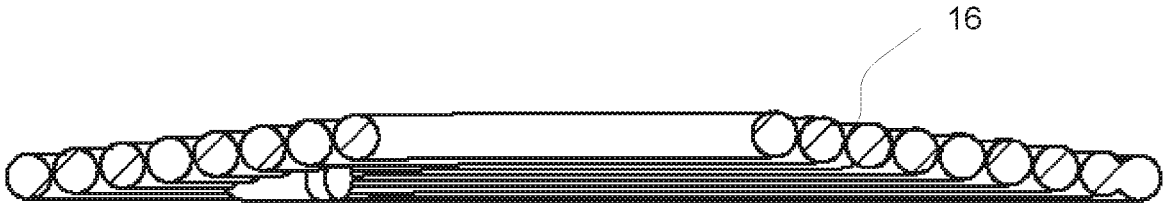
FIG. 10 is a side view cutaway drawing illustrating one embodiment of a spring.

FIG. 10 is a side view cutaway drawing illustrating one embodiment of a compressed spring 110*b*. In the depicted embodiment, each spring coil 116 of the nests completely within a neighboring spring coil 16. As a result, a spring segment 23 may have a compressed length 21 that is substantially equivalent to a diameter of each spring coil 116. As used herein, substantially equivalent refers to within plus or minus 50%.

Figure 11:
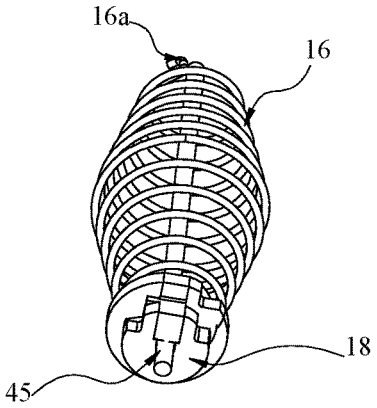
FIG. 11 is a perspective drawing of a spring coil.

FIG. 11 is a perspective drawing of a spring coil 16. The spring spacer 18 is shown on the cable 45.

Figure 12:
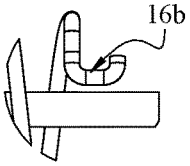
FIG. 12 is a side view drawing of a spring coil end.

FIG. 12 is a side view drawing of a spring coil end 16*b*.

Figure 13:
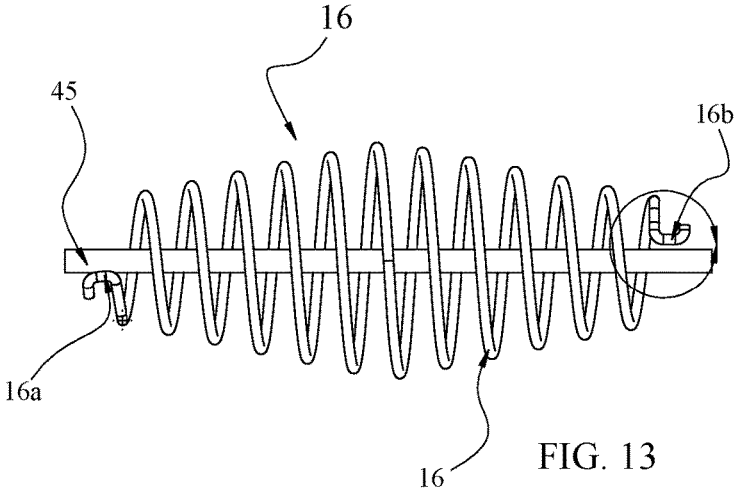
FIG. 13 is a side view drawing of a spring coil.

FIG. 13 is a side view drawing of a spring coil 16. The spring coil ends 16*a/b* are shown.

Figure 14:
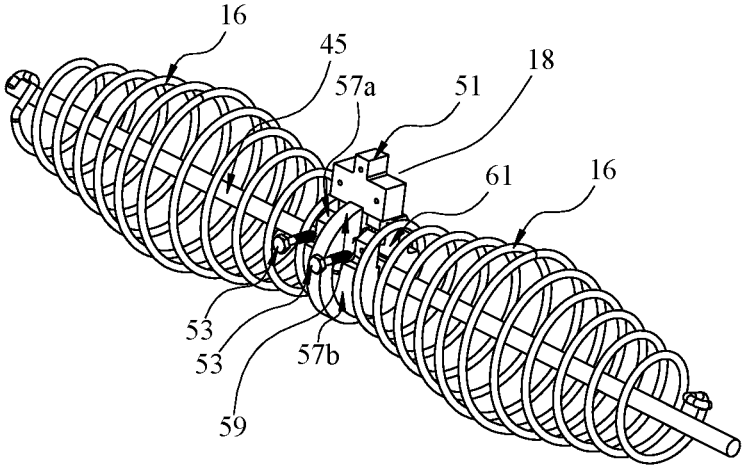
FIG. 14 is a perspective drawing illustrating one embodiment of springs and a spring spacer.

FIG. 14 is a perspective drawing illustrating one embodiment of springs 16 and a spring spacer 18. The springs 16 compress to slow and/or stop a zip line trolley 10. The spring spacer 18 maintains the relative alignment of the spring coils 16 about a central axis and/or cable 45. Thus, as the springs coils 16 compress, the spring coils 16 nest within each other, increasing the effectiveness of the spring coils 16.

The outer diameter of the spring coils 15 may be 5 inches plus or minus 0.5 inches. The spring coils 16 may be in the range of 0.125-0.375 inches (4-10 mm) in diameter and consist of carbon or stainless steel and compress in the range of 25 to 125 lbs.

The spring spacer 18 comprises an inner disc 55 and two outer discs 57. A spring spacer slot 61 is formed from an edge of the inner disc 55 and the two outer discs 57*a* and 57*b*, to the central axis. The spring spacer 18 is fit to a cable 45 with the cable 45 at the central axis. The spring spacer 18 may be formed of Ultra High Molecular Weight Polyethylene.

The spring spacer 18 comprises lock notches 59. Inner ends of two spring coils 16 are rotated independently in the spring spacer slot 61 and disposed in a lock notches 59. An insert lock 51 locks the inner ends of the spring coils 16 as will be shown hereafter. The insert lock 51 may be secured to the spring spacer 18 with lag screws 53.

The compressed spring coils 16 nest partially on the inner disc 55 and around the outer disc 57*a* and 57*b*, nesting completely within a neighboring spring coil 16. The cable 45 passes through the two spring coils 16. In one embodiment, the insert lock 51 seamlessly fills the spring spacer slot 61.

Figure 15:
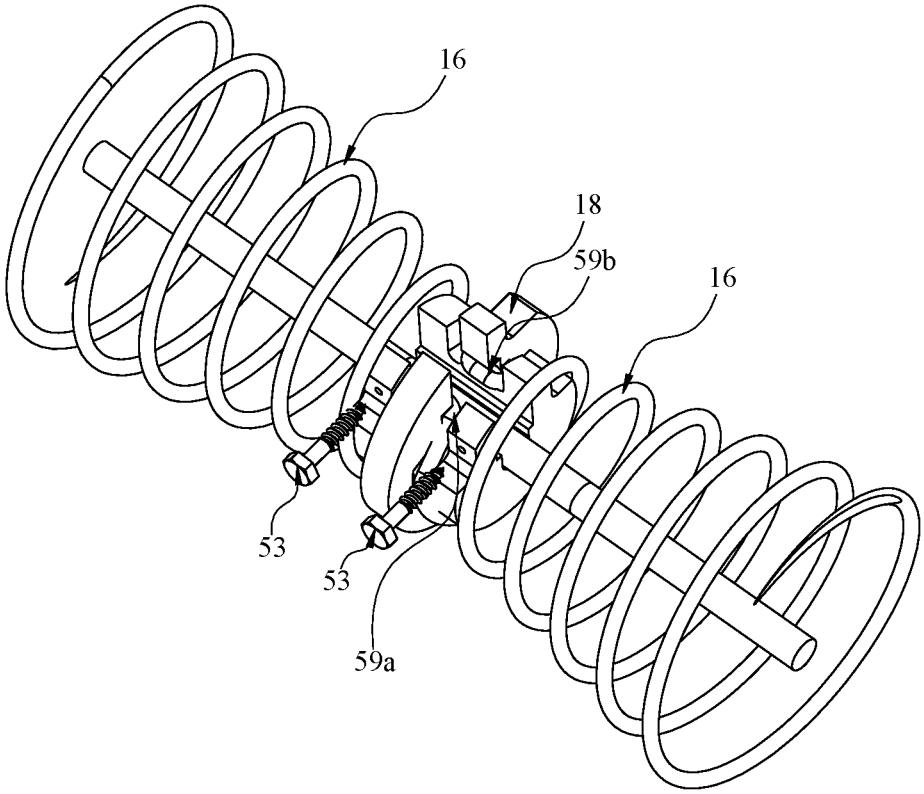
FIG. 15 is a perspective drawing illustrating one embodiment of springs and a spring spacer.

FIG. 15 is a perspective drawing illustrating one embodiment of the springs 16 and the spring spacer 18. In the depicted embodiment, the insert lock 51 is fit into the spring spacer slot 61 and is secured to the spring spacer 18 with the lag screws 53, locking the inner ends of the springs 16 to the spring spacer 18. Lock notches 59*a/b* receive the coil springs 16.

Figure 16:
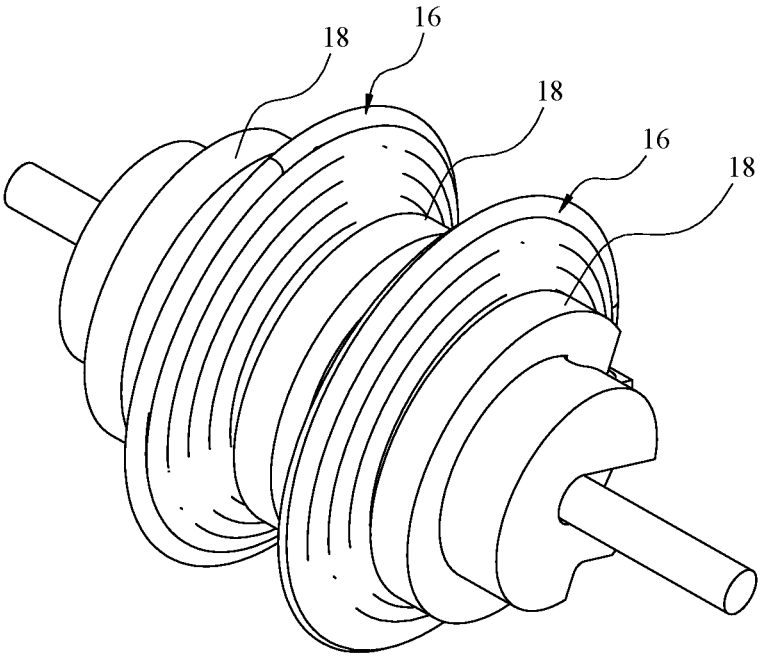
FIG. 16 is a perspective drawing illustrating one embodiment of compressed springs.

FIG. 16 is a perspective drawing illustrating one embodiment of compressed springs 16. The springs 16 are shown compressed with the spring spacer 18 positioning spring coils 16 to nest within neighboring spring coils 16.

Figure 17:
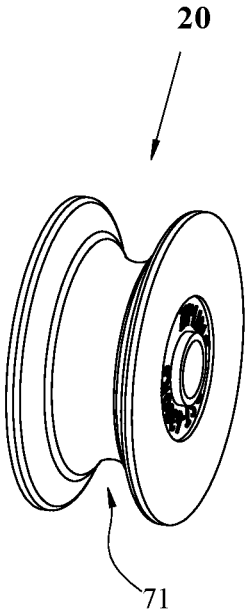
FIG. 17 is a perspective view drawing illustrating one embodiment of a wheel.

FIG. 17 is a perspective view drawing illustrating one embodiment of a wheel 20. The wheel comprises a parabolic grove 71. The parabolic groove 71 supports a plurality of cable sizes. The parabolic opening of the wheel allows the trolley to start on a ⅜-inch cable 45. As the rider moves through the zip tour and the cable 45 is now ⅝-inch diameter (longer zip line runs require larger diameter cable to meet industry safety factors) and longer, the trolley with the parabolic wheel 20 allows the tour guide to keep using the same trolley through the entire zip line tour. One trolley for the entire zip line tour. Example first zip line run may be 1000 ft long and with a ½-inch cable 45, the next zip line run may be 2500 feet and requiring a ⅝-inch cable 45, and the last two zip line runs are 4000 feet long and requiring a ¾-inch diameter cable 45.

Figure 18:
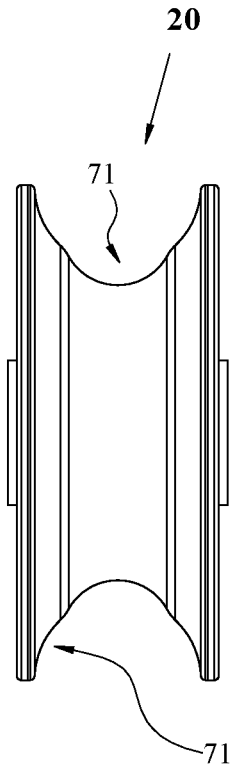
FIG. 18 is a front view drawing illustrating one embodiment of a wheel.

FIG. 18 is a front view drawing illustrating one embodiment of the wheel 20 and the parabolic groove 71.

Figure 19:
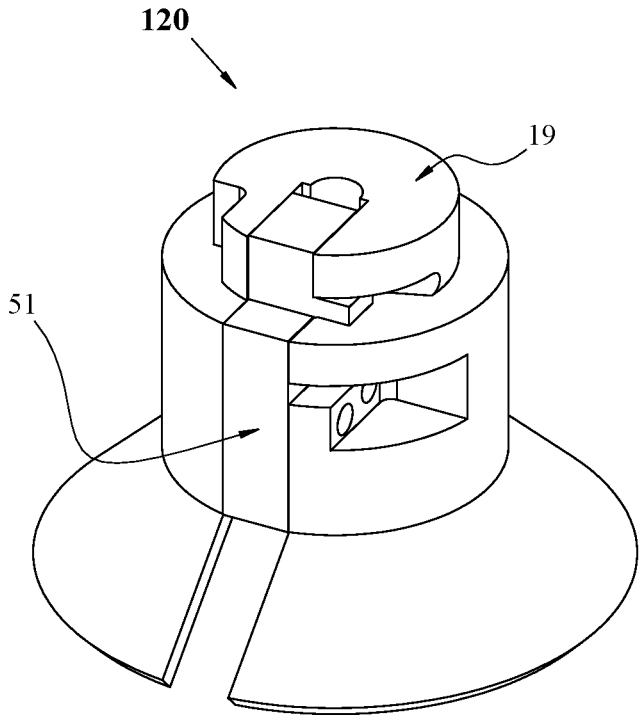
FIG. 19 is a perspective drawing of one embodiment of a wheel.

FIG. 19 is a perspective drawing of one embodiment of the receiver 120. The receiver 120 includes an insert lock 51 and a spring spacer receiver 19. The insert lock 51 retains the receiver 120 on the cable 45.

Figure 20:
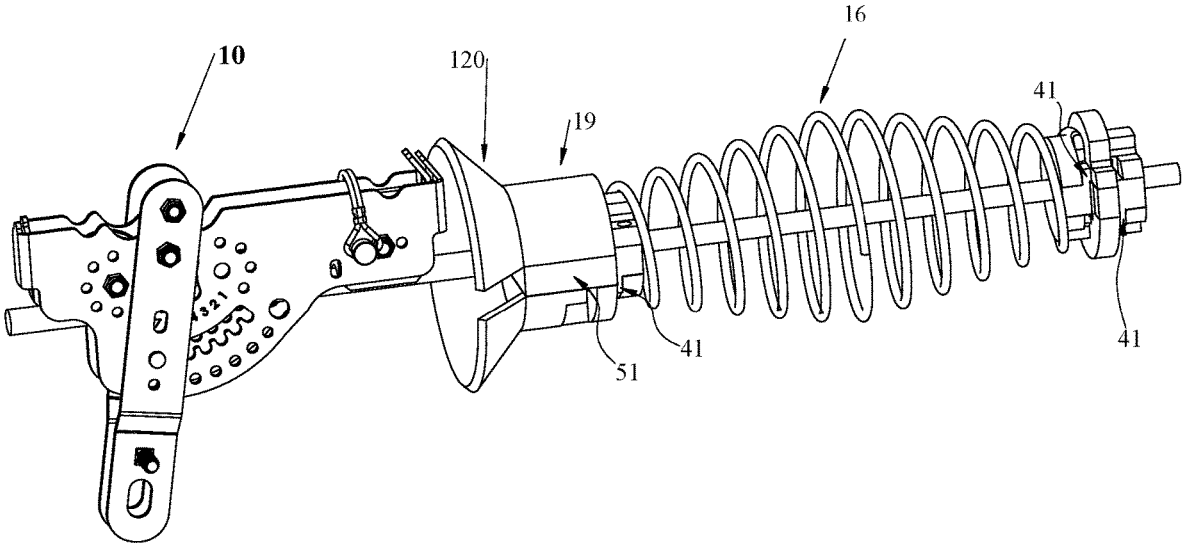
FIG. 20 is a perspective drawing of one embodiment of a spring spacer and insert lock.

FIG. 20 is a perspective drawing of one embodiment of the zip line trolley 10 contacting the receiver 120. The spacer insert is shown. The protruding tab 41 holds the spring wire end loop preventing the rotation of the spring and locking the inner end of a spring 16 to the bump spring spacer receiver 19 and the spring spacer 18 may be formed of Ultra High Molecular Weight Polyethylene. The protruding tab 41 may have dimensions of 0.38X-0.22 inches.

Figure 21:
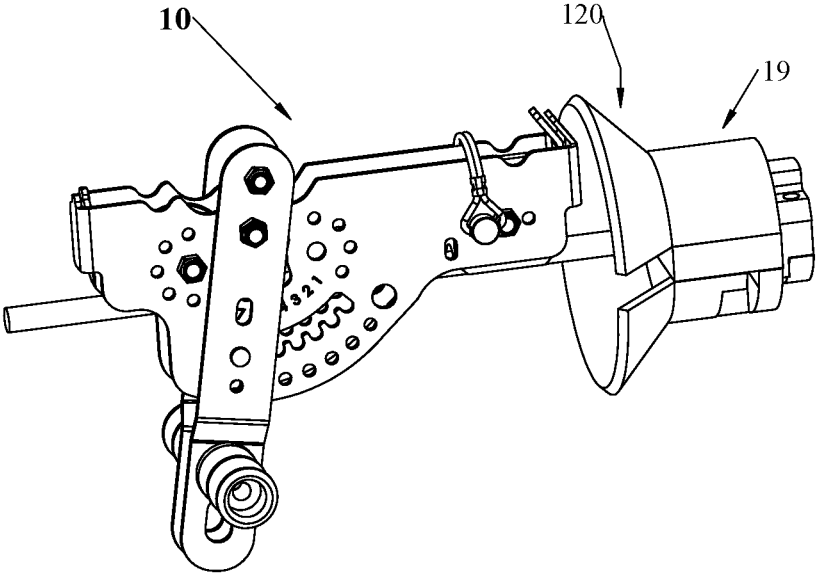
FIG. 21 is a perspective drawing of one embodiment of a spring spacer and insert lock.

FIG. 21 is a perspective drawing of one embodiment of the zip line trolley 10 contacting the receiver 120 and bump spring spacer receiver 19 perspective drawing views.

Figure 22:
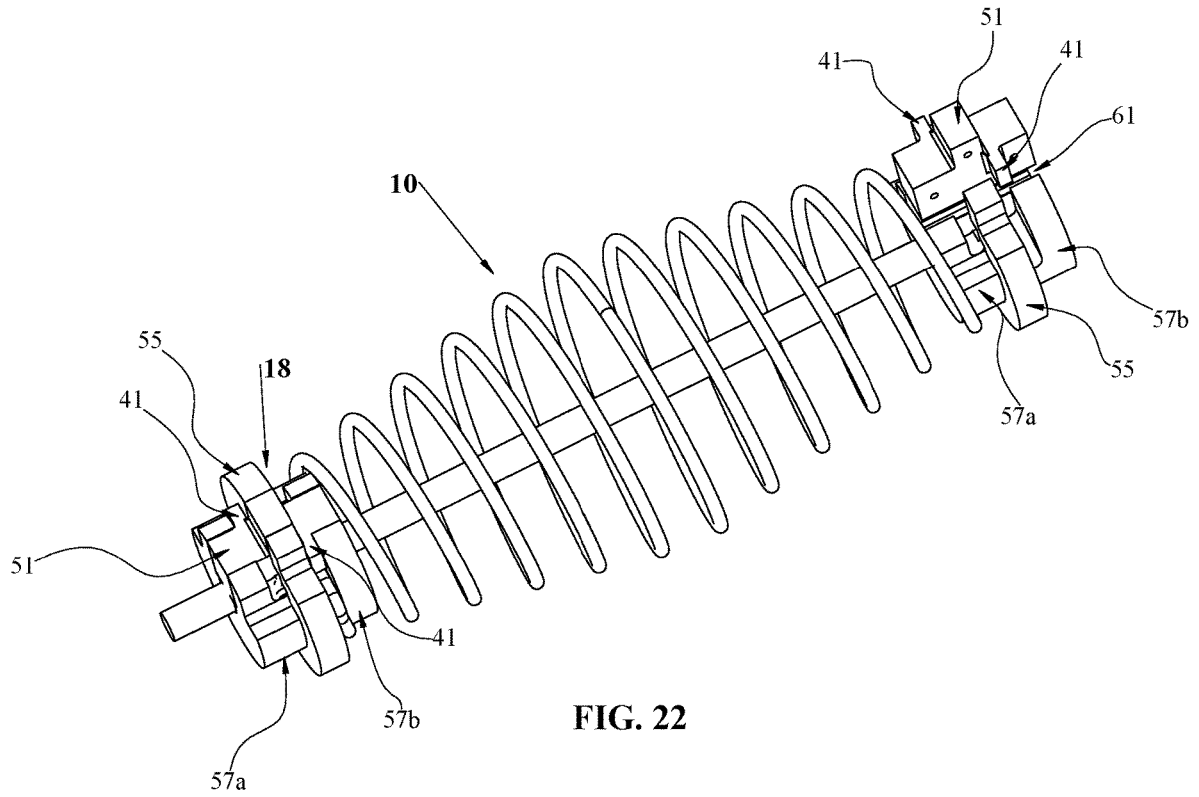
FIG. 22 is a perspective drawing of one embodiment of a spring spacer and insert lock.

FIG. 22 is a perspective drawing of a spring 16 with one embodiment of a protruding tab 41. The spring spacer 18 comprises an inner disc 55 and two outer discs 57*a* and 57*b*. A spring spacer slot 61 is formed from an edge of the inner disc 55 and the two outer discs 57*a* and 57*b*. The insert lock 51 with protruding tabs 41 holds two spring wire loops preventing the rotation of the spring and locking the inner ends of the springs 16 to the spring spacer 18 may be formed of Ultra High Molecular Weight Polyethylene.

Figure 23:
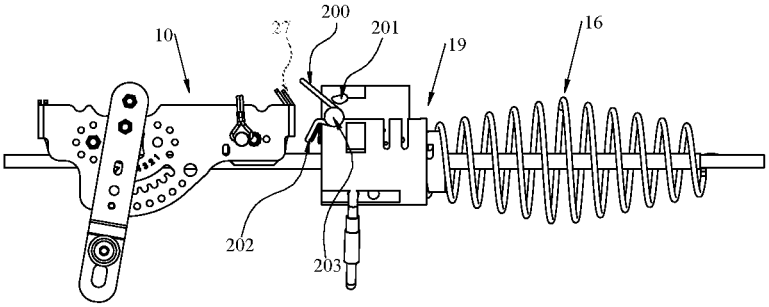
FIG. 23 is a side view drawing illustrating one embodiment of a zip line trolley.

FIG. 23 is a side view drawing illustrating one embodiment of a zip line trolley 10 with brake stop angled tab hitch 27 before contacting a modified bump receiver 19 with a compression spring 202 loaded or ready to receive catcher lever arm 200 an internal rotating shaft 203 a rotating cam 201 catcher and a barrel spring 16. The rotating cam 201 rotates to lock the receive catcher lever arm 200 down compressing the spring 202 once the trolley 10 has impacted the modified bump receiver 19 the rotating cam 201 rotates down holding 200 in place so the bottom tower staff member can real the trolley and rider on to the platform.

Figure 24:
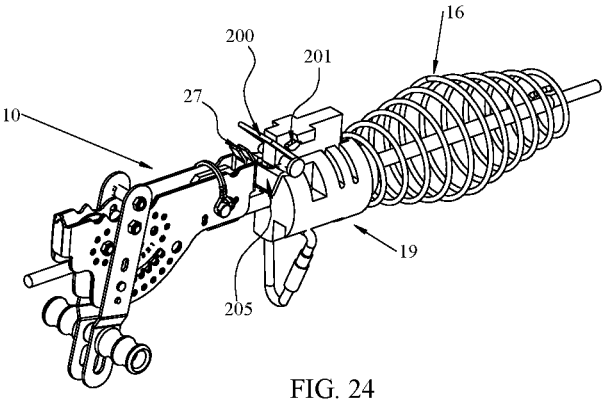
FIG. 24 is a perspective drawing illustrating one embodiment of a zip line trolley.

FIG. 24 is a perspective drawing illustrating one embodiment of a zip line trolley 10 with brake stop angled tab hitch 27 before contacting a bump receiver 19 with a compression spring loaded bump plate 205 and a rotating cam 201 a loaded or ready to receive the zip line trolley 10 and a barrel spring 16. The brake stop angled tab hitch 27 is received by the receive catcher 200 and locked in place by the receive catcher 200.

Figure 25:
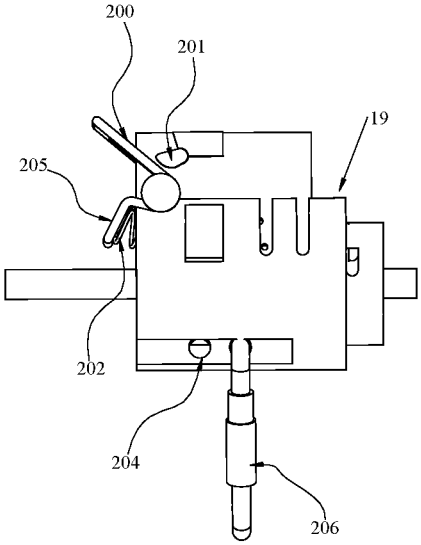
FIG. 25 is a side view drawing illustrating one embodiment of a bump receiver.

FIG. 25 is a side view drawing illustrating one embodiment of a bump receiver 19 with a loaded or ready to receive catcher 200, a compression spring 202 loaded or ready to receive catcher 200, a rotating cam 201, the bump plate 205, and a hole 204 for a carabiner 206.

Figure 26:
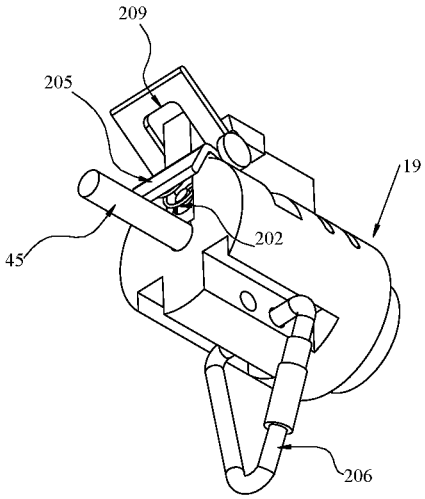
FIG. 26 is a perspective underside view drawing illustrating one embodiment of a bump receiver.

FIG. 26 is a perspective underside view drawing illustrating one embodiment of a bump receiver 19 with a spring-loaded bump plate 205 for the receiver catcher 200 and the catcher hole 209 is ready to catch a zip line trolley 10 riding on the cable 45 and a carabiner 206.

Figure 27:
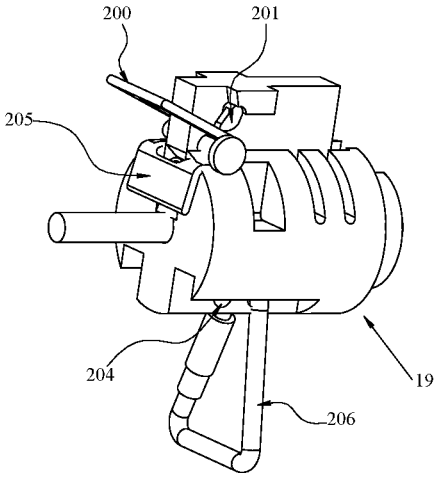
FIG. 27 is a perspective view drawing illustrating one embodiment of a bump receiver.

FIG. 27 is a perspective view drawing illustrating one embodiment of a bump receiver 19 with a compressed catcher 200, a locked cam 201 compressing the bump plate 205 compressed against bump receiver 19, and a hole 204 for a carabiner 206.

Figure 28:
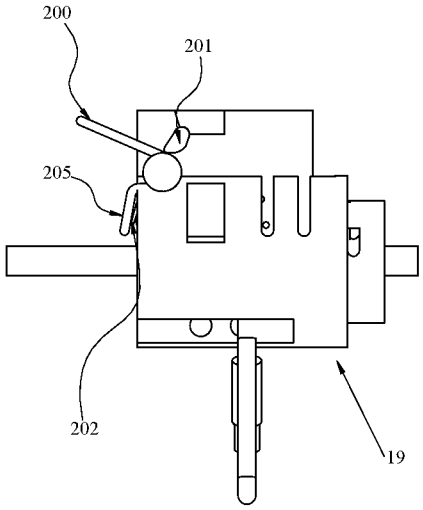
FIG. 28 is a side view drawing illustrating one embodiment of a bump receiver.

FIG. 28 is a side view drawing illustrating one embodiment of a bump receiver 19 compressing the compression spring 202. The bump plate 205 adjacent to the bump receiver 19 is locked in place by the cam lock 201 staying movement.

Figure 29:
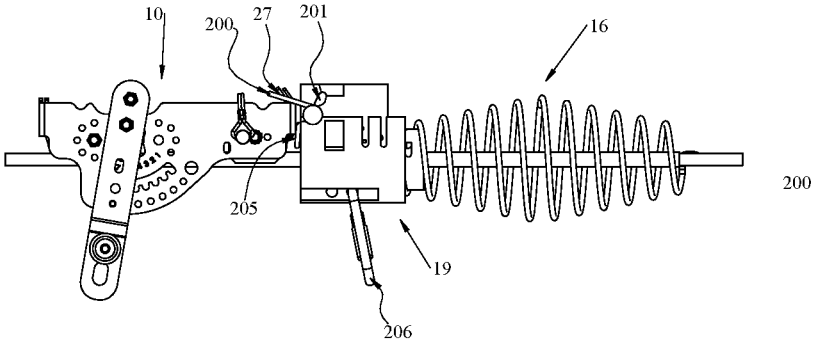
FIG. 29 is a side view drawing illustrating one embodiment is a zip line trolley.

FIG. 29 is a side view drawing illustrating one embodiment is a zip line trolley 10 mating with the bump receiver 19 with the receive catcher 200 connecting the zip line trolley 10 with the bump receiver 19 pressing the catcher face plate 205 so the zip line attendant can pull the zip line rider in with a rope connected to a carabiner 206 on the bottom of the bump receiver 19. The rotating cam 201 keeps the receive catcher 200 from springing back and mates the bump receiver 19 and the zip line trolley 10.

Figure 30:
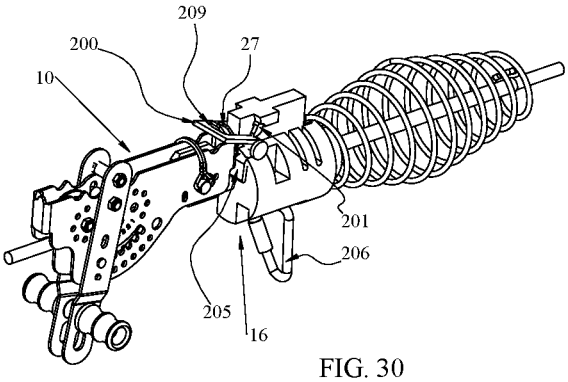
FIG. 30 is a perspective view drawing illustrating one embodiment is a zip line trolley.

FIG. 30 is a perspective view drawing illustrating one embodiment is a zip line trolley 10 mating with the bump receiver 19 with the receive catcher 200 connecting the trolley's 10 brake stop angled tab hitch 27 nested in the catcher hole 209 with the catcher receiver 200 locking cam 201 as the stop pressed the catcher face plate 205 locking the brake stop angled tab hitch 27 so the zip line attendant can pull the zip line rider in with a rope connected to a carabiner 206 on the bottom of the bump receiver 19. The cam lock 201 keeps the catcher lever 200 from springing back so the trolley 10 and the bump receiver 19 can be towed to a platform.

Figure 31:
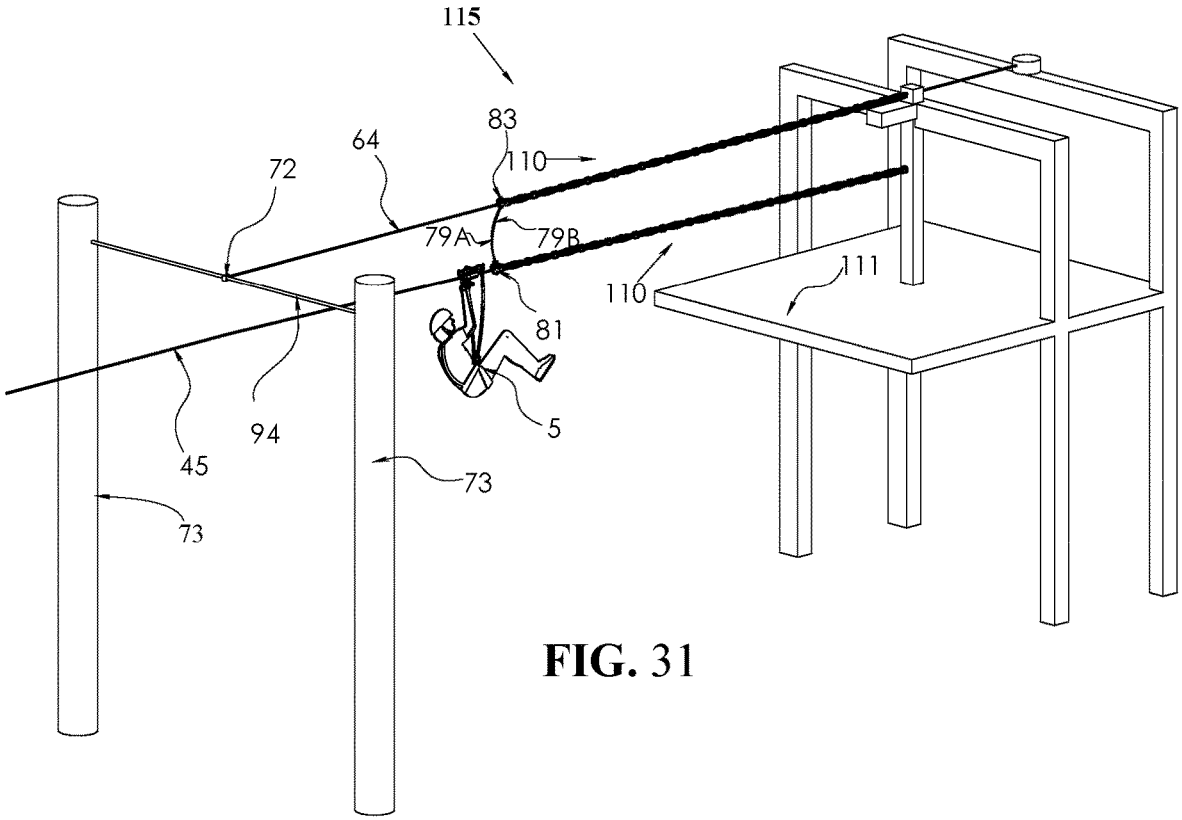
FIG. 31 is an isometric drawing illustrating one embodiment of multiple spring dampening zip line braking system.

FIG. 31 is an isometric drawing illustrating a multiple spring dampening zip line braking system 115. In the depicted embodiment, a suspended cable 45 is supported near a landing platform 111. Two support columns 13 suspend a cross cable 94 substantially perpendicular to the zip line cable 45. A connector 72 attaches a non-zip liner parallel cable 64 to the cross cable 94. In the depicted embodiment, the non-zip liner parallel cable 64 is disposed above the zip line cable 45. The non-zip liner parallel cable 64 may be disposed at other positions adjacent to the zip line cable 45. At least one 110 spring and at least one spacer 18 may be disposed on the non-zip liner parallel cable 64. In addition, a freewheeling pulley 83 is disposed on the non-zip liner parallel cable 64.

At least one spring 110 and at least one spacer 18 may be disposed on the zip line cable 45. An impact device 81 is also disposed on the zip line cable 45 between the zip line trolley 10 and the at least one spring 110 and at least one spacer 18. A primary tether 79A and/or a secondary tether 79B connects the impact device 81 and the freewheeling pulley 83. The springs 110 are positioned as to provide a multiple spring dampening zip line braking system 115.

The at least one spring 110 and at least one spacer 18 are each disposed on one of the zip line cable 45 and the non-zip liner parallel cable 64. The springs 110 may comprise helix spring wire wound with a fixed diameter uniformly single layer around a cylinder with uniformly spaced circles or rings. The spacer 18 may connect at least two spring segments 28 to form a spring 110.

In one embodiment, the springs 110 comprise an array of helical spring coils 16. Each spring coil set helix may comprise spring wire wound with a fixed diameter in a uniformly single layer around a cylinder uniformly spaced circles. comprising a cylindrical compression and/or a helix spring wire wound fixed diameter uniformly single layer around a cylinder can be ununiformly spaced circles. In a certain embodiment, each helical spring coils 16 comprises a cylindrical compression and/or a largest diameter center wire coil apex mirrored so as to taper between a range of 15 degrees thru 0.5-degree slope to both distal and proximal ends of the helical spring coils 16 tapering from a mid-point with nesting spring coils at both small diameter ends of the telescoping barrel shaped spring coils 16 in a stacked linear arrays.

In response to the zip line trolley 10 descending the cable 45 and impacting the impact device 81, the impact device 81 applies a force to the freewheeling pulley 83 via the primary tether 79A and/or secondary tether 79B. The freewheeling pulley 83 impacts the at least one 110 spring and at least one spacer 18 disposed on the non-zip liner parallel cable 64 and the at least one 110 spring and at least one spacer 18 disposed on the non-zip liner parallel cable 64 slow the zip line trolley 10 by compressing the at least one spring 110. In one embodiment, the impact device 81 motivated by the zip line trolley 10 further impacts the at least one spring 110 and at least one spacer 18 disposed on the zip line cable 45, further slowing the zip line trolley 10 as the at least one spring 110 compresses. The at least one 110 spring and at least one spacer 18 of the non-zip liner parallel cable 64 and the zip line cable 45 dampen and slow the rider 5 that is suspended below the zip line trolley 10. The system 115 applies proportion braking force to variable masses of riders 5 traversing a zip line cable 45, increasing rider safety.

In response to the zip line trolley 10 descending the cable 45 and impacting the impact device 81, the impact device 81 applies a force to the freewheeling pulley 83 via the primary tether 79 and/or secondary tether 79. The freewheeling pulley 83 impacts the at least one 110 spring and at least one spacer 18 disposed on the non-zip liner parallel cable 64 and the at least one 110 spring and at least one spacer 18 disposed on the non-zip liner parallel cable 64 slows the freewheeling pulley 83 by compressing the at least one spring 110. The freewheeling pulley 83 decelerates the impact device 81 and the zip line trolley 10 via the at least one tether 79 to a stop. In one embodiment, the impact device 81 motivated by the zip line trolley 10 further impacts the at least one spring 110 and at least one spacer 18 disposed on the zip line cable 45, further slowing the zip line trolley 10 as the at least one spring 110 compresses.

Figure 32:
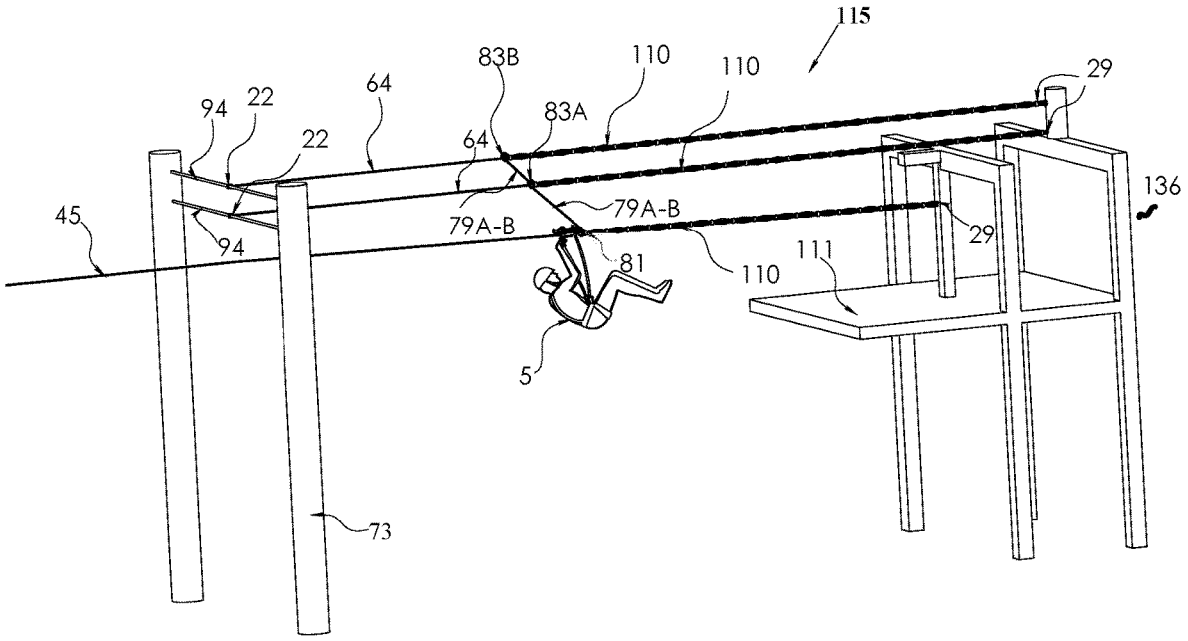
FIG. 32 is a dimetric perspective drawing illustrating one alternate embodiment of a multiple spring dampening zip line braking system.

In one embodiment, the zip line trolley 10 includes a multi concave wheeled. In addition, the zip line trolley 10 may comprise a concave wheel and a concave brake. The zip line braking system 115 is disposed on a proximal end of multiple column frame with a cable spread between columns. The cable can cable spread between columns has a cable connector to support a perpendicular cable forming T-section with an array of springs parallel to the zip line cable. The frame includes several arrays of compression springs to dampen and slow trolley with variable weighted hanging masses suspended below the zip line cable. The weight applies a force about the wheel to the brake to control a rate of descent of the device along the cable. A more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which:

FIG. 32 is a dimetric perspective drawing illustrating a multiple spring dampening zip line braking system 115 with multiple non-zip liner parallel cables 64. In the depicted embodiment, each non-zip liner parallel cable 64 comprises at least one spring 110 and at least one spacer 18 disposed above the zip line cable 45. The zip line cable 45 may also comprise at least one spring 110 and at least one spacer 18.

In the depicted embodiment, two non-zip liner parallel cables 64 are suspended from two cross cables 94 supported by at least two support columns 73. Any number of cross cables 94 and non-zip liner parallel cables 64 may be employed. Thus, the non-zip liner parallel cables 64 start near the landing platform 111. The non-zip liner parallel cables 64 may start in the range of 10 to 40 meters from the landing platform 111.

The at least one non-zip liner parallel cable 64 may be connected to a cross member 94 by at least one connector 72, forming at least one T cable section. Ends of the at least one T section may be horizontal and may be connected to the two vertical support columns 73. The zip line cable 45 and/or non-zip liner parallel cables 64 may connect to anchors 29. The anchors 29 may be connected to a structure 136. The non-zip liner parallel cables 64 may be attached to the anchors above the landing zone 111.

The support columns 73 may be spaced at least 80 inches apart. Each cross cable 94 may include a connector 22. Each connector 22 suspends a non-zip liner parallel cable 64 adjacent to the zip line cable 45. The primary tether 79A and/or the secondary tether 79B connect the impact device 81 to at least one freewheeling pulley 83 each disposed on a non-zip liner parallel cables 64. In the depicted embodiment, a first primary tether 79A and/or a first secondary tether 79B connect the impact device 81 to a first freewheeling pulley 83A. In addition, a second primary tether 79A and/or a second secondary tether 79B connect the first freewheeling pulley 83A to a second freewheeling pulley 83B. Each tether 79 may be made from a material selected from the group consisting of a solid metallic rod, nylon tap, and a woven strap.

The impact device 81 may ride on the zip line cable 45. The impact device 81 may be positioned down the zip line cable 45 from the zip line trolley 10 that rides on the zip line cable 45. The at least one non-zip liner parallel cable 64 is adjacent the zip line cable 45. The impact device (61) does not ride on the at least one non-zip liner parallel cable 64. In one embodiment, the impact device 120 includes a receiver 120 that receives the zip line trolley 10.

The receiver 120 may comprise at least one indent that each receives a corresponding protrusion on the zip line trolley 10. In one embodiment, at least one indent comprises a broad opening that receives the protrusion of the zip line trolley 10 when an orientation angle of the zip line trolley 10 is rotated plus or minus 90 degrees to an orientation angle of the receiver 120. The indent may further slope to a deeper recess wherein when the protrusion is in the recess the orientation angle of the zip line trolley 10 is aligned with the orientation angle of the receiver 120. The receiver 120 may motivates the zip line trolley 10 to center on the zip line cable 45. In one embodiment, the receiver 120 includes a latch that latches the zip line trolley 10.

At least one freewheeling pulley 83 each may ride on the at least one non-zip liner parallel cable 64. The at least one tether 79 may connect the impact device 81 to a first freewheeling pulley 83. Each freewheeling pulley 83 may connect to subsequent freewheeling pulleys 63 wherein the impact device 61 applies a force to the first freewheeling pulley 83. Each tether 79 may apply tension to each freewheeling pulley 83 disposed on a corresponding one non-zip liner parallel cable 64 at an angle between 40 and 60 degrees from the zip line cable 45.

In response to the zip line trolley 10 descending the cable 45 and impacting the impact device 81, the impact device 81 applies a force to the first freewheeling pulley 83A via the first primary tether 79A and/or first secondary tether 79B. The freewheeling pulley 83 impacts the at least one 110 spring and at least one spacer 18 disposed on the non-zip liner parallel cable 64 and the at least one 110 spring and at least one spacer 18 disposed on the non-zip liner parallel cable 64 slows the zip line trolley 10 by compressing the at least one spring 110. In one embodiment, the impact device 81 motivated by the zip line trolley 10 further impacts the at least one spring 110 and at least one spacer 18 disposed on the zip line cable 45, further slowing the zip line trolley 10 as the at least one spring 110 compresses. In one embodiment, the impact trolley 61 comprises a receiver that receives the zip line trolley 10 and motivates the zip line trolley 10 to center on the zip line cable 45.

In one embodiment, the impact device 81 and/or freewheeling pulley 83 is a sliding device surrounds the zip line cable 45 and that slides along the zip line cable 45. In a certain embodiment, the impact device 81 and/or freewheeling pulley 83 comprises at least one wheel selected from the group of a low coefficient of friction cylinder polymer and a low coefficient of friction cylinder composite.

Figure 33:
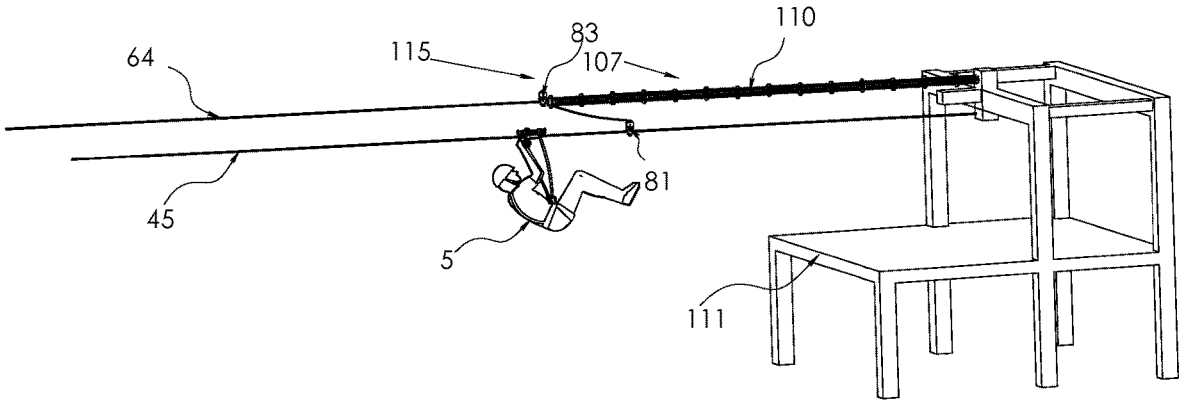
FIG. 33 is a dimetric perspective drawing illustrating one embodiment of a zip line braking system.

FIG. 33 is a dimetric perspective drawing illustrating a zip line braking system 115. In the depicted embodiment, at least non-zip liner parallel cable 64 is suspended adjacent the zip line cable 45. The zip line cable 45 may have no springs 110. The non-zip liner parallel cable 64 may have substantially the same length as the zip line cable 45. The at least one spring 110 and at least one spacer 18 may be organized in a spring array 107.

In response to the zip line trolley 10 descending the cable 45 and impacting the impact device 81, the impact device 81 applies a force to the freewheeling pulley 83 via the primary tether 79 and/or secondary tether 79. The freewheeling pulley 83 impacts the at least one 110 spring and at least one spacer 18 disposed on the non-zip liner parallel cable 64 and the at least one 110 spring and at least one spacer 18 disposed on the non-zip liner parallel cable 64 slows the freewheeling pulley 83 by compressing the at least one spring 110. The freewheeling pulley 83 decelerates the impact 61 device and the zip line trolley 10 via the at least one tether 79 to a stop.

Figure 34:
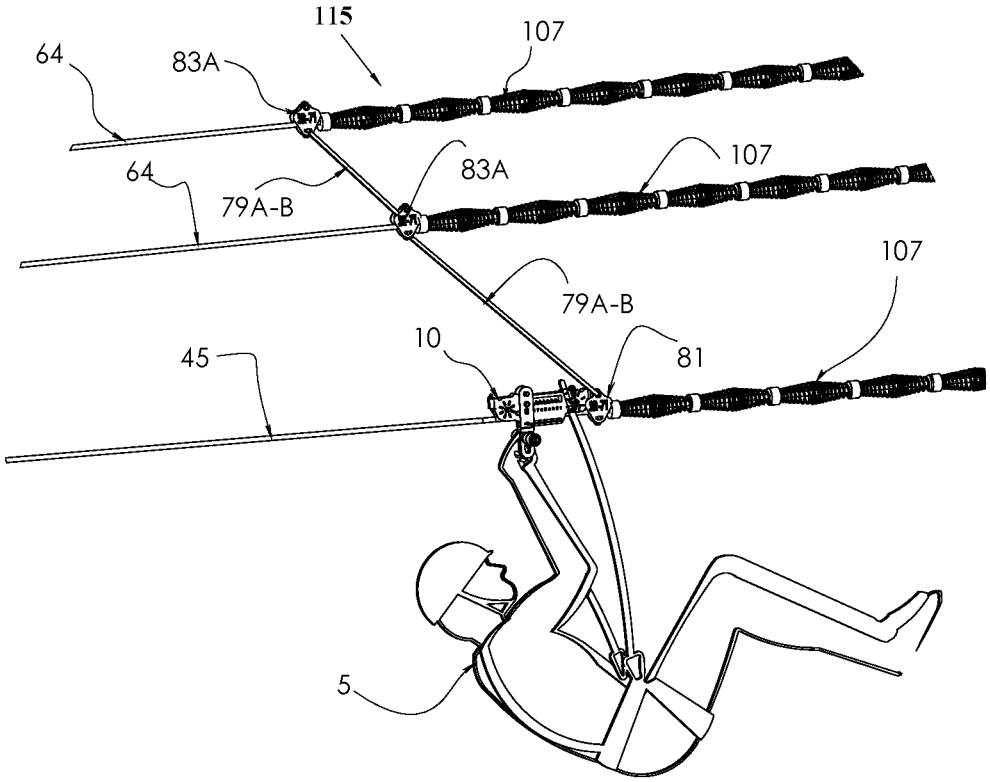
FIG. 34 is a section view drawing illustrating one embodiment of a zip line braking system.

FIG. 34 is a section view drawing illustrating a zip line braking system 115. In the depicted embodiment, the at least one non-zip liner parallel cable 64 is disposed substantially parallel to the zip line cable 45. As used herein, substantially parallel is within 0 to 30 degrees of horizontal First tethers 79A-B connect the impact device 81 to a first freewheeling pulleys 63A. In addition, second tethers 79A-B connect the first freewheeling pulleys 63A to a second freewheeling pulley 83B.

Figure 35:
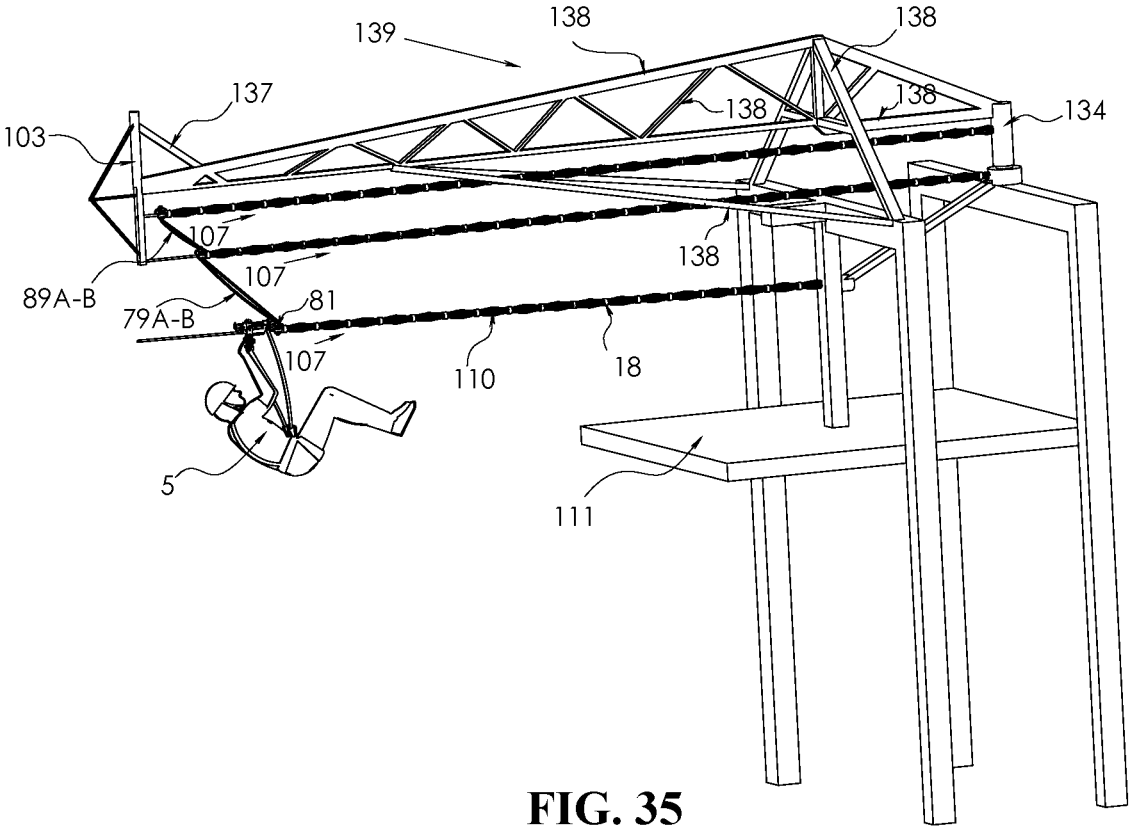
FIG. 35 is a dimetric perspective drawing illustrating one embodiment of a multiple array spring dampening zip line braking system.

FIG. 35 is a dimetric perspective drawing illustrating a multiple spring array dampening zip line braking system 115. In the depicted embodiment, two non-zip liner parallel cables 64 are supported by one vertical support column 103 supported by one or more cantilever struts 137. The support column 103 is supported by a mono truss 139 or a dual pitch truss above the zip line cable 45 and two non-zip liner parallel cables 64. The support column 103 is further supported by cantilever struts 137. The truss 139 may comprise truss members 138. Two or more redundant fail-safe tethers 89A-B are backup to one or more primary tethers 79A-B which tightens as the rider 5 is safely slowed to a stop by the springs 110 and spacers 18 of the at least one spring array 107 near the landing platform 111.

The spring arrays 107 are disposed on the non-zip liner parallel cables 64 above the zip line cable 45. The two spring arrays 107 are positioned as to provide a multiple spring dampening zip line braking system 115.

In one embodiment, the spring arrays 107 on the non-zip liner parallel cables 64 and the zip line cable 45 combine to decelerate a zip line trolley 10 and rider 5 with a mass of 40 to 150 kilograms (kg) with deceleration in the range of 250 meters/second$^2$ (m/s$^2$) to 60 m/s$^2$.

Figure 36:
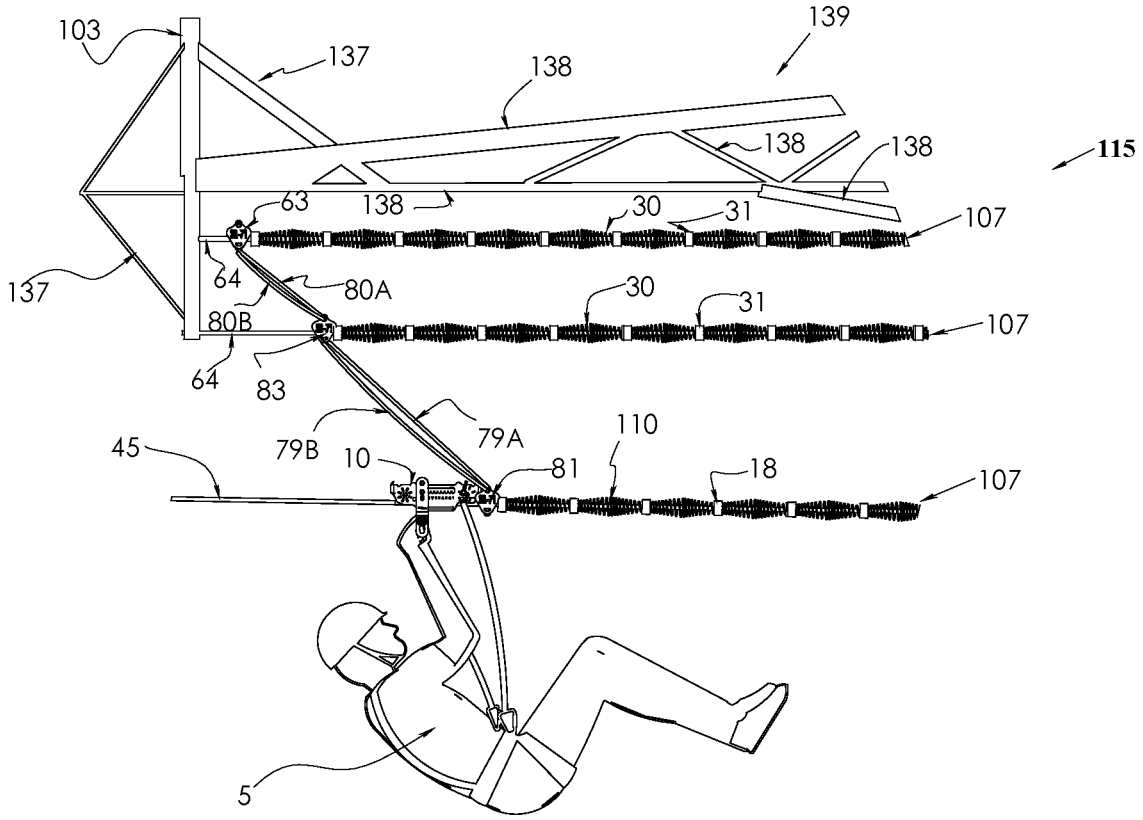
FIG. 36 is a side view drawing illustrating one embodiment of a multiple array spring dampening zip line braking system.

FIG. 36 is a side view drawing illustrating multiple array spring dampening zip line braking system 115 of FIG. 35. One or more redundant fail-safe tethers 80A-B are backup to one or more tethers 79A-B that apply tension from the impact device 81 as the zip line trolley 10 impacts the impact device 81 to the freewheeling pulleys 63. The springs 110 of the spring arrays 107 are compressed, decelerating the zip line trolley 10 so that the rider 5 is safely slowed and stopped at the landing platform 111.

In the depicted embodiment, the zip cable 45 above is non-zip liner parallel cable 64 is connected to a vertical support 33 with spanning primary tethers and secondary tethers. The zip line cable 45 supported by a mono truss 39 and a freewheeling pulley 83A or sliding device above the zip line cable 45. Multiple spring arrays 110 of springs 110 and spacers 18 are disposed on the non-zip liner parallel cables 64 spanning linearly above and on the zip line cable 45. The four tethers 79A-B/80A-B are stretched diagonally as the zip line trolley 10 impacts the impact device 81.

Figure 37:
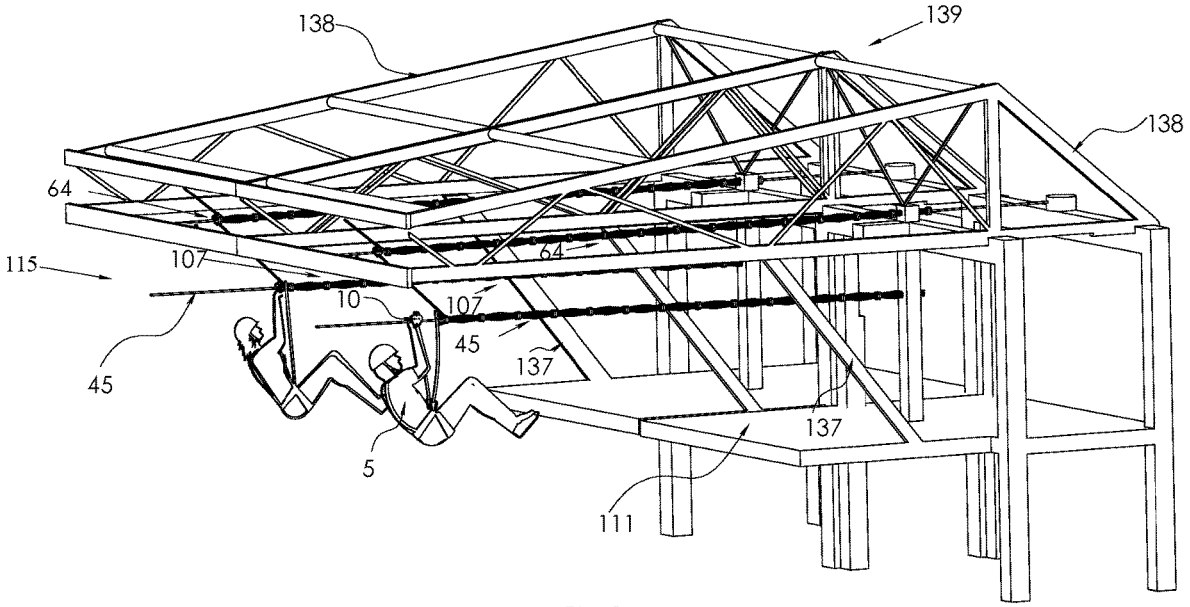
FIG. 37 is a perspective drawing illustrating one embodiment of an extended landing platform with two zip line cables.

FIG. 37 is a dimetric view drawing illustrating an extended landing platform 111 with two zip line cables 45. Each zip line cable 45 may comprise a spring array 107. Multiple mono trusses 39 support two non-zip liner parallel cables 64 with spring arrays 107 above two or more zip line cables 45 The combination of the spring arrays of the non-zip liner parallel cable 64 and the spring arrays 107 of the zip liner cable 45 decelerate the zip line trolley 10 and rider 5 to a stop above the landing platforms 11.

Figure 38:
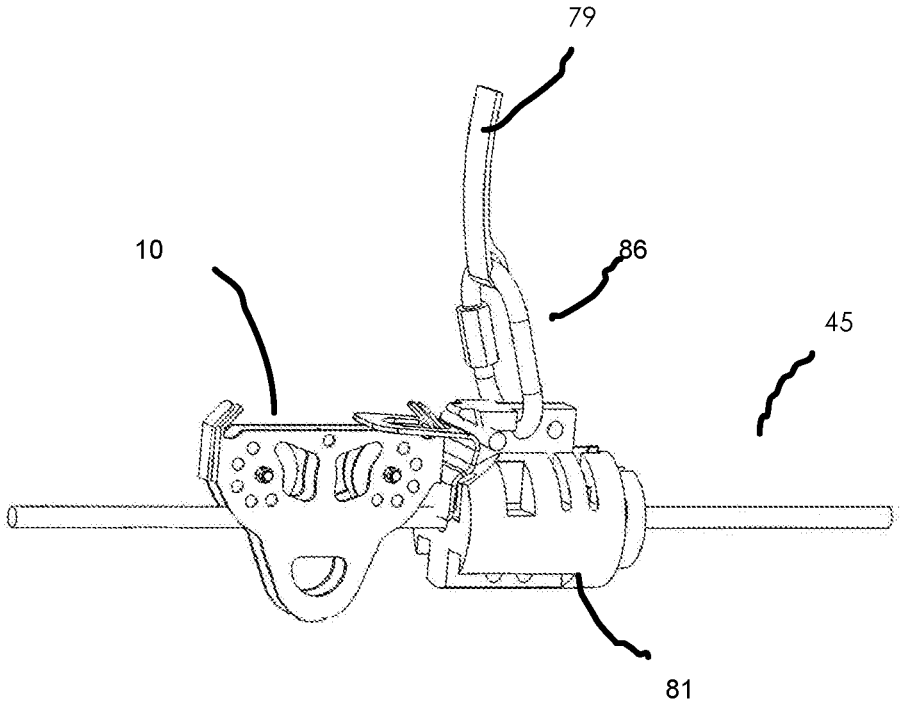
FIG. 38 is a perspective drawing illustrating one embodiment of a zip line trolley and impact device.

FIG. 38 is a perspective drawing illustrating one embodiment of a zip line trolley 10 and impact device 81. The zip line trolley 10 is shown contacting the impact device 81. The impact device 81 is connected to the tether 79 with a carabiner 86.

Embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A braking system comprising:

a zip line cable;

a zip line trolley with only one wheel that rides on the zip line cable;

an impact device riding on the zip line cable, wherein the impact device is positioned down the zip line cable from the zip line trolley;

at least two non-zip liner parallel cables, wherein the impact device does not ride on the at least two non-zip liner parallel cables;

at least two freewheeling pulleys each riding on one of the at least two non-zip liner parallel cables;

a first tether that connects the impact device to a first freewheeling pulley, and at least one subsequent tether that connects freewheeling pulleys on subsequent of the at least two non-zip liner parallel cables, wherein each freewheeling pulley is connected to at least one other freewheeling pulley by the at least one subsequent tether, the impact device applies a force to the first freewheeling pulley via the tether in response to a zip line trolley contacting the impact device, and the at least one subsequent tether applies a force from the first freewheeling pulley to each other freewheeling pulley; and at least one spring disposed on each of the at least two non-zip liner parallel cables that slows the at least two freewheeling pulleys, wherein the at least two freewheeling pulleys decelerates the impact device and the zip line trolley via the at least one tether to a stop.

2. The braking system of claim 1, wherein the at least two non-zip liner parallel cables have substantially the same length as the zip line cable.

3. The braking system of claim 1, wherein the at least two non-zip liner parallel cables are connected to a cross member by at least one connector, forming at least one T cable section.

4. The braking system of claim 3, wherein ends of the at least one T cable section is horizontal and is connected to two vertical supports.

5. The braking system of claim 3, wherein the at least two non-zip liner parallel cables landing platform is anchored above a landing zone.

6. The braking system of claim 1, wherein each spring has spring segment arrays of springs paralleling horizontally above the zip line cable.

7. The braking system of claim 6, the at least one spring and at least one spacer are each disposed on one of the zip line cable and the at least two non-zip liner parallel cables, wherein the springs comprise helix spring wire wound with a fixed diameter uniformly single layer around a cylinder with uniformly spaced circles or rings.

8. The braking system of claim 7, wherein the at least one spacer connects at least two spring segments to form the spring.

9. The braking system of claim 6, the at least one spring comprising an array of helical spring coils, each spring coil helix comprising spring wire wound with a fixed diameter in a uniformly single layer around a cylinder in uniformly spaced circles.

10. The braking system of claim 6, the at least one spring comprising an array of helical spring coils, each helical spring coil comprising a cylindrical compression and/or a largest diameter center wire coil apex mirrored so as to taper between a range of 15 degrees thru 0.5 degree slope to both distal and proximal ends of the helical spring coils tapering from a mid-point with nesting spring coils at both small diameter ends of the telescoping barrel shaped spring coils in a stacked linear arrays.

11. The braking system of claim 1, wherein each tether applies tension to each freewheeling pulley disposed on a corresponding one non-zip liner parallel cable at an angle between 40 and 60 degrees.

12. The braking system of claim 1, wherein the impact device comprises a receiver that receives the zip line trolley and motivates the zip line trolley to center on the zip line cable.

13. The braking system of claim 1, wherein the each tether is made from a material selected from the group consisting of a solid metallic rod, nylon tap, and a woven strap.

14. The braking system of claim 1, wherein the impact device one wheel is selected from the group consisting of a low coefficient of friction cylinder polymer and a low coefficient of friction cylinder composite.

* * * * *